US009062462B2

(12) United States Patent
Michel et al.

(10) Patent No.: US 9,062,462 B2
(45) **Date of Patent: *Jun. 23, 2015**

(54) TRELLIS AND ACCENT BAND

(71) Applicant: Division 8 Products, Inc., Frederic, WI (US)

(72) Inventors: Timothy J. Michel, Lindstrom, MN (US); Eric Goodman, Newport, MN (US); Ned H. Albert, Burnsville, MN (US)

(73) Assignee: Division 8 Products, Inc., Lindstrom, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/157,169

(22) Filed: Jan. 16, 2014

(65) Prior Publication Data

US 2014/0196381 A1 Jul. 17, 2014

Related U.S. Application Data

(63) Continuation of application No. 13/149,267, filed on May 31, 2011, now Pat. No. 8,739,473, which is a continuation-in-part of application No. 12/276,100, filed on Nov. 21, 2008, now Pat. No. 8,037,645.

(51) Int. Cl.

| | |
|---|---|
| ***E04B 1/74*** | (2006.01) |
| ***E04F 10/00*** | (2006.01) |
| ***E04F 10/02*** | (2006.01) |
| *E04F 10/08* | (2006.01) |
| *E04F 13/21* | (2006.01) |

(52) U.S. Cl.

CPC ..... *E04F 10/005* (2013.01); *E04F 10/02* (2013.01); *E04F 10/08* (2013.01); *E04F 13/21* (2013.01)

(58) Field of Classification Search

CPC ..... E04F 10/00; E04F 10/02; E04F 10/08; E04F 13/21; E04F 13/00; E04F 13/002; E04D 5/00; E04B 7/14

USPC ..... 52/78, 73, 75, 74, 76, 77, 151, 273, 52/93.2, 94, 96, 223.11, 223.7, 223.6

See application file for complete search history.

(56) References Cited

U.S. PATENT DOCUMENTS

| | | | |
|---|---|---|---|
| 1,579,289 | A | 4/1926 | Edwards |
| 2,449,069 | A | 9/1948 | Harrison |

(Continued)

OTHER PUBLICATIONS

Application and File History for U.S. Appl. No. 12/276,100, filed Nov. 21, 2008. Inventors: Tim Michel et al.

(Continued)

*Primary Examiner* — Phi A

(74) *Attorney, Agent, or Firm* — Patterson Thuente Pedersen, P.A.

(57) ABSTRACT

A trellis system is disclosed wherein the trellis comprises a front tube, a back tube, and two end tubes joined together, a plurality of roof panels, each panel having a perimeter, wherein the perimeter of the panel is coupled to at least a back tube surface and a front tube surface; a plurality of cross member assemblies wherein the cross member assemblies assist in creating tension between the front tube and the back tube, and a plurality of fasteners coupling the front tube to the end tubes, the back tube to the end tubes, and the roof panels to at least the front tube and the back tube, wherein the fasteners are not visible when the trellis system is installed. The trellis system also includes accent bands. A plurality of turnbuckles allows for easy leveling of the trellis.

27 Claims, 29 Drawing Sheets

(56) References Cited

U.S. PATENT DOCUMENTS

| | | | | |
|---|---|---|---|---|
| 2,539,705 | A | | 1/1951 | Simonton |
| 2,569,388 | A | | 9/1951 | Rogers et al. |
| 2,602,199 | A | | 7/1952 | Kendall |
| 2,618,820 | A | | 11/1952 | Struben et al. |
| 2,629,904 | A | | 3/1953 | Bristow |
| 2,701,397 | A | | 2/1955 | Taylor |
| 2,735,224 | A | | 2/1956 | Estey |
| 2,762,089 | A | | 9/1956 | Auble |
| 2,848,764 | A | | 8/1958 | Turteltaub |
| 3,103,715 | A | | 9/1963 | Noecker |
| 3,107,401 | A | | 10/1963 | Heirich |
| 3,218,773 | A | | 11/1965 | Heirich |
| 3,289,351 | A | | 12/1966 | Ford |
| 3,300,941 | A | | 1/1967 | Heirich |
| 3,388,510 | A | | 6/1968 | Smith et al. |
| 3,396,496 | A | | 8/1968 | Roberts |
| 3,402,516 | A | | 9/1968 | Kanarr |
| 3,567,816 | A | | 3/1971 | Embree |
| 3,984,951 | A | | 10/1976 | Hindman |
| 3,994,104 | A | | 11/1976 | Gurrola |
| 4,100,703 | A | * | 7/1978 | Sickler ..... 52/16 |
| 4,125,978 | A | | 11/1978 | Schildge, Jr. |
| 4,205,496 | A | | 6/1980 | Heirich |
| 4,285,175 | A | | 8/1981 | Struben et al. |
| 4,411,109 | A | | 10/1983 | Struben et al. |
| 4,627,203 | A | | 12/1986 | Presswalla et al. |
| 4,726,153 | A | | 2/1988 | Adler et al. |
| 5,044,131 | A | | 9/1991 | Fisher |
| 5,148,640 | A | * | 9/1992 | Reilly, Sr. ..... 52/74 |
| 5,242,004 | A | | 9/1993 | Stilling |
| 5,469,672 | A | | 11/1995 | Fisher |
| 5,603,134 | A | | 2/1997 | Whipkey et al. |
| 5,809,713 | A | | 9/1998 | Ray |
| 8,037,645 | B2 | | 10/2011 | Michel et al. |
| 2011/0302871 | A1 | | 12/2011 | Michel et al. |

OTHER PUBLICATIONS

Application and File History for U.S. Appl. No. 13/149,267, filed May 31, 2011. Inventors: Tim Michel et al.

* cited by examiner

TRELLIS AND ACCENT BAND

RELATED APPLICATION

This application is continuation of application Ser. No. 13/149,267 filed May 31, 2011 and entitled "Trellis and Accent Band" which is a continuation-in-part of application Ser. No. 12/276,100 filed Nov. 21, 2008 and entitled "Trellis and Accent Band", now U.S. Pat. No. 8,037,645, issued Oct. 18, 2011, all of which are hereby fully incorporated herein by reference.

FIELD OF THE INVENTION

The invention is generally related to a building trellis or overhang, and installation of the trellis or overhang system on a building. More particularly, the invention is directed to a trellis or overhang structure that is attached to the side of a building, where the trellis or overhang has no exposed fasteners, thus achieving an aesthetically pleasing appearance. Further, the trellis or overhang has fewer parts than prior art trellises, resulting in more efficient fabrication and installation.

BACKGROUND OF THE INVENTION

The exterior of a building can be modified with an awning, trellis or overhang structure to provide the building with additional exterior coverage. The awning, trellis or overhang can provide additional shade to the building and to the area underneath the awning, trellis, or overhang, as well as protection from the elements such as rain, snow, and ice. Canvas awnings that roll-up are popularly used for store fronts and restaurants, to provide shade, protection from the rain, and can be aesthetically appealing to consumers. Generally, a winding device is used to roll/fold these canvas awnings into place against the building front when the awning is no longer desired. These canvas awnings are not designed to withstand severe weather; heavy snow, rain or wind, and are more a decorative and shade-providing device. However, some awnings are made from metal, such as aluminum, and are generally sturdier than the canvas awnings, and can also be folded away when no longer desired. These types of awnings generally slope away from the building such that any rain, snow or ice slides off the edge of the awning. Further, these awnings generally have many parts, are time-consuming to install, and have aesthetically unpleasing exposed fasteners.

Some buildings can have a trellis or overhang attached to the side of the building. Oftentimes the trellis or overhang is attached to the side of the building and the roof of the trellis/overhang is supported by columns or posts. Such an overhang structure attached to the side of a house often functions as a carport. Generally, the roof comprises a number of flat panels made of metal, plastic or wood. Here, too, the fasteners used to construct the trellis/overhang are visible and not aesthetically pleasing. Further, there are many pieces involved in constructing such a trellis/overhang. Also, a trellis/overhang constructed with posts supporting the roof of the trellis/overhang is subject to cars and people running into the posts. The posts may be especially prone to be damaged if the trellis/overhang is attached to a business, such as a bank with a drive-up window. Drivers of cars may misjudge distances and damage the posts supporting the roof.

There is a need for a trellis or overhang that has fewer parts for fabrication and installation as compared to the trellises and overhangs in the prior art. Further, there is a need for a trellis/overhang that does not require the use of support posts and is aesthetically pleasing by, at least, eliminating exposed fasteners.

SUMMARY OF THE INVENTION

The present invention is directed to a trellis or overhang for mounting to the side of a building. The structure can be variously referred to as a trellis, an overhang or a sunshade. Hereinafter, the term trellis will be used for the inventive structure. Generally, the trellis is made of metal, for example, aluminum; however other materials can be used in constructing the trellis.

In one aspect of the invention, the trellis includes in-fill panels that form the cover or roof structure of the trellis, the in-fill panels connected to one another by tubular cross-members or outriggers. The in-fill panels are angled such that rain and melting snow is urged off the panels and onto the ground, through drains 140 positioned at the edges of the in-fill panels. Further, the trellis is affixed to the side of the building by way of a series of turnbuckles, which are also utilized to level the trellis structure. The turnbuckles allow for ease of arranging the trellis to the level arrangement desired.

In another aspect of the invention, the in-fill panels of the trellis are connected to one another by cross members. A cross member includes a hollow tube, preferably with a quadrilateral cross-section, that also includes a threaded rod. The ends of the threaded rod are attached to the back tube of the trellis and the front tube (or fascia) of the trellis. The end of the threaded rod attached to the back tube includes a nut which can be tightened, thus securing and tightening the in-fill panels and front and back tubes in place.

In yet another aspect of the invention, the trellis can be largely pre-assembled at another location and brought to the installation site essentially ready to affix to the side of the building. The trellis is formed from in-fill panels, generally in 4 foot wide and 6 foot long sections. Often, the required length for the trellis is 24 feet, hence four such in-fill panels can be attached to one another and to the 24 foot front and back support tubes to form the required length. Further, because the trellis is modular, if a part of the trellis is damaged, for example, hit by a truck, then the in-fill panel can be removed and replaced. The trellis does not require posts or columns to support the roof; the turnbuckles and fasteners affixing the back tube to the building provide the necessary support.

In another aspect of the invention, the trellis system includes the trellis structure as well as accent banding that can be affixed to the building, to give the building an aesthetically pleasing appearance. The back surface of the accent band includes a plurality of keyhole slots. The accent band can be affixed to the building using a plurality of carriage bolts affixed to the building side that engage with a matching plurality of keyhole slots in the back surface of the accent band. The accent band that is proximate the trellis structure can be joined to the trellis, for example, to the trellis back tube, by way of a splice sleeve, thereby forming an unobrusive hairline joint.

In another aspect of the invention, the in-fill panels are riveted to the cross members or cross-members, to hold the in-fill panels in place. The panels are designed such that the lower face of the panel is pleasing in appearance, as that is the surface that will be visible to the public. Further, the structure of the trellis does not require bolts, rivets, or other fasteners to be used in the front surface of the front tube or fascia, or in the front face of the exterior side tubes of the trellis. Hence, the trellis of the invention presents a visually appealing surface, with no fasteners showing.

In yet another aspect of the invention, the trellis includes in-fill panels that comprise stiffeners. In one aspect, the stiffeners take on the shape of a hat channel, that is, a channel shaped like an upside-down top hat. However, other stiffener shapes are contemplated. The stiffeners are affixed, by fasteners or industrial adhesive, to the top surface of the in-fill panels, to provide for additional strength to the panels. The stiffeners provide additional strength against accumulated snow, in cold climates, and against updrafts in coastal regions.

The above summary of the various representative embodiments of the invention is not intended to describe each illustrated embodiment or every implementation of the invention. Rather, the embodiments are chosen and described so that others skilled in the art may appreciate and understand the principles and practices of the invention. The figures in the detailed description that follows more particularly exemplify these embodiments.

BRIEF DESCRIPTION OF THE DRAWINGS

These as well as other objects and advantages of this invention will be more completely understood and appreciated by referring to the following more detailed description of the exemplary embodiments of the invention in conjunction with the accompanying drawings. The invention will be explained in more detail below, by way of example and with reference to the enclosed drawings, which also disclose features essential to the invention and wherein.

Figure 1:
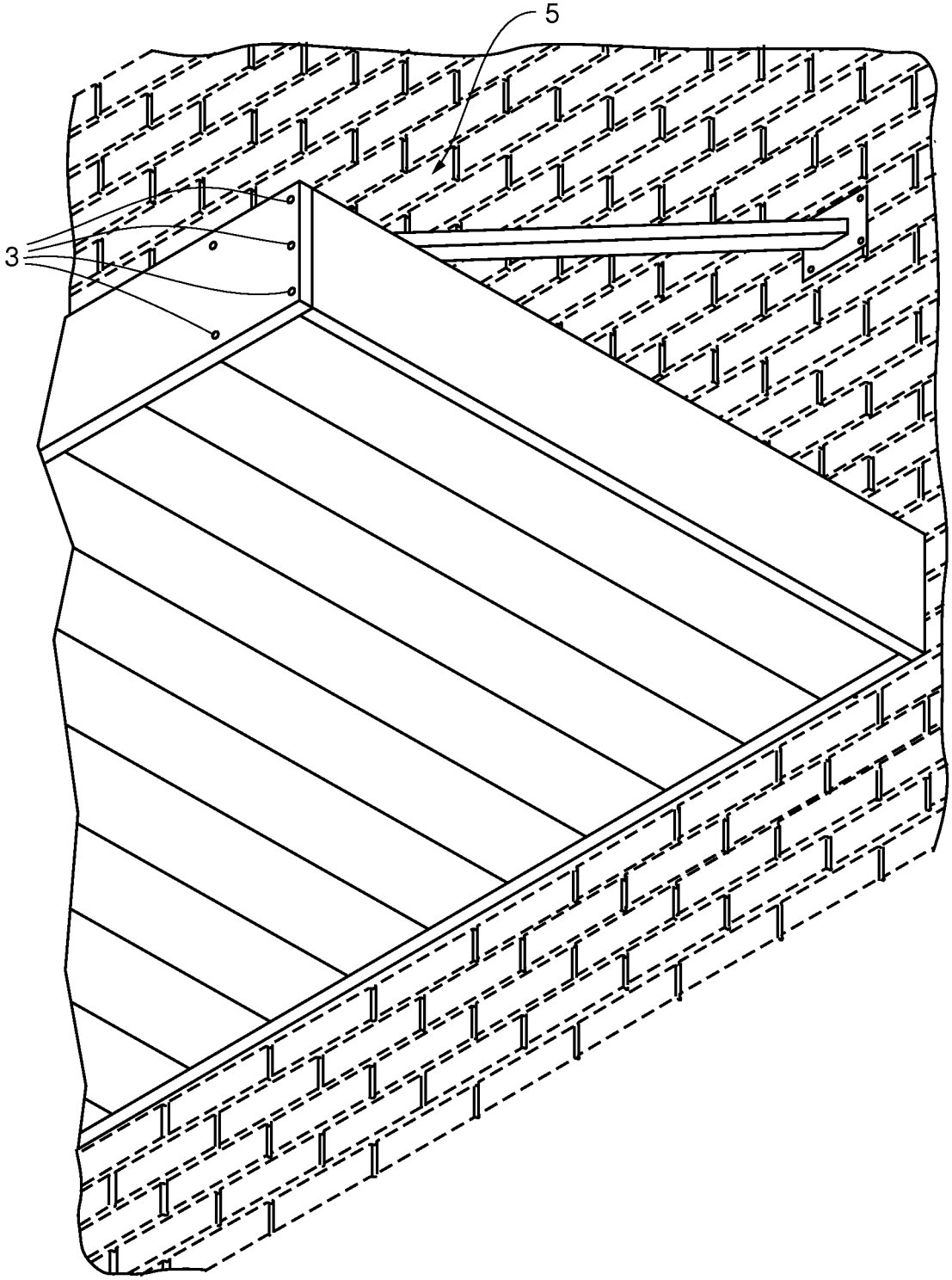
Fig. 1 Prior Art
FIG. 1 is a bottom perspective view of a prior art trellis, showing the attachment to a building.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE DRAWINGS

Figure 2:
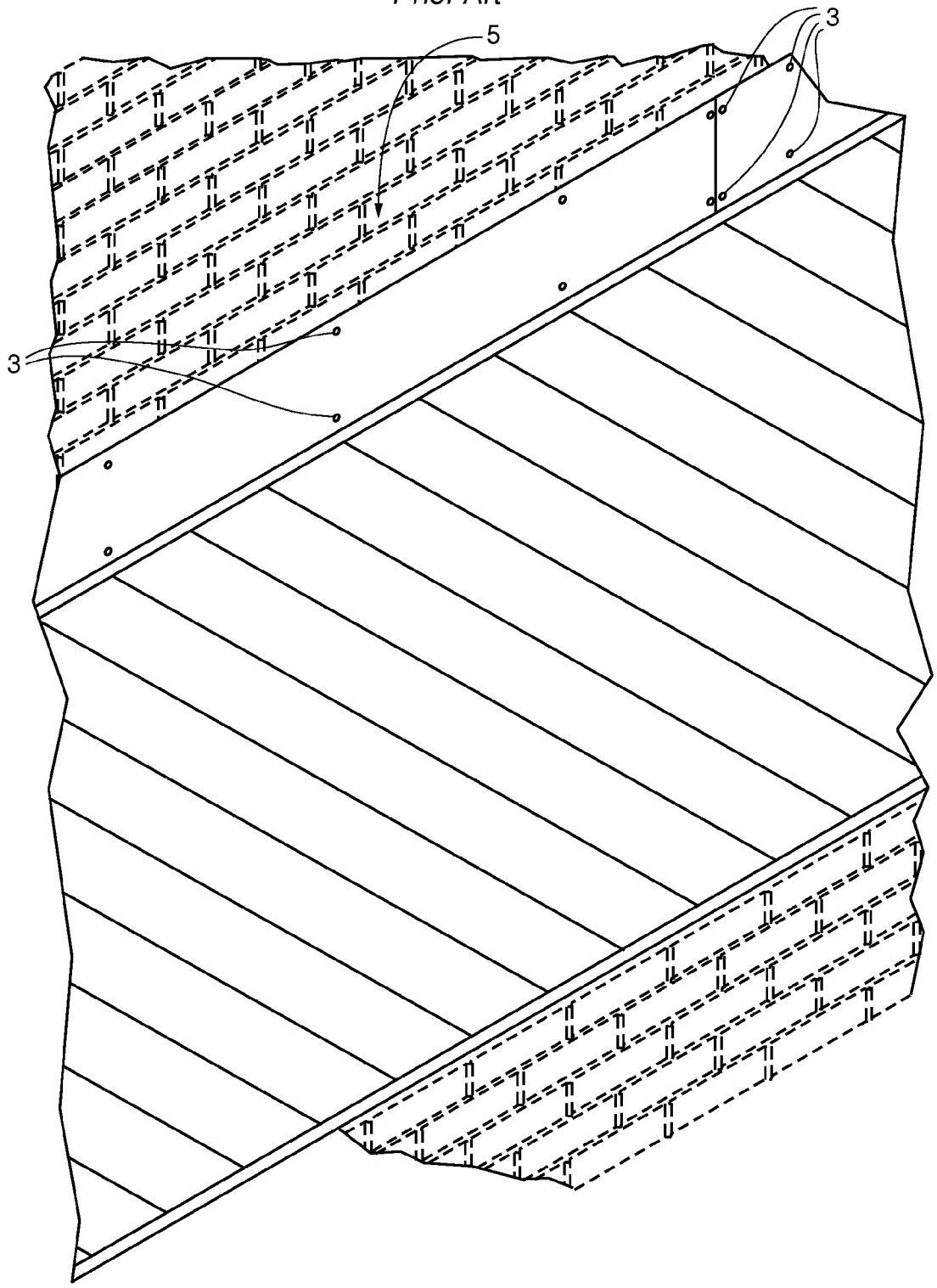
Fig. 2 Prior Art
FIG. 2 is a bottom perspective view of a prior art trellis.

FIGS. 1 and 2 show examples of a prior art trellis structure 5. The trellis 5 in each figure, noticeably, has fasteners 3 showing on the exterior of the trellis 5. In particular, the fastener heads 3 can be seen on the front fascia or facing of the trellis 5. The positioning of the fasteners 3 on the front fascia allows for the fasteners 3 to be generally seen by the public, resulting in a less than aesthetically pleasing frontage. Because the types of trellises 5 shown in FIGS. 1 and 2 are often used in consumer related businesses, for example, bank drive-up windows, fast food drive-up windows, and coffee purveyor drive-up windows, the businesses generally desire to have an aesthetically pleasing frontage that is also efficiently and economically constructed and installed.

Figure 3A:
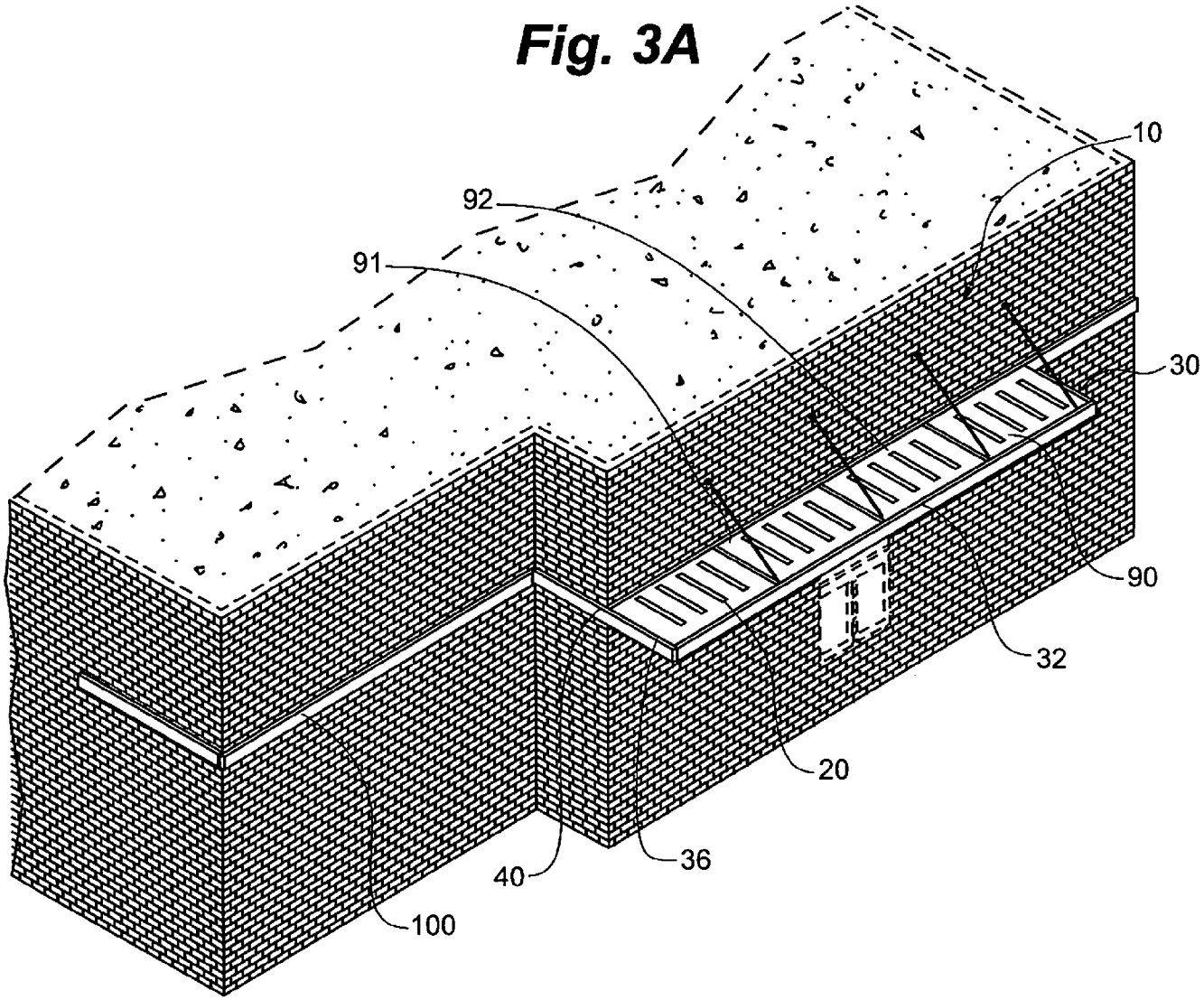
FIG. 3A shows a top perspective view of an embodiment of a trellis of the invention.
Figure 3B:
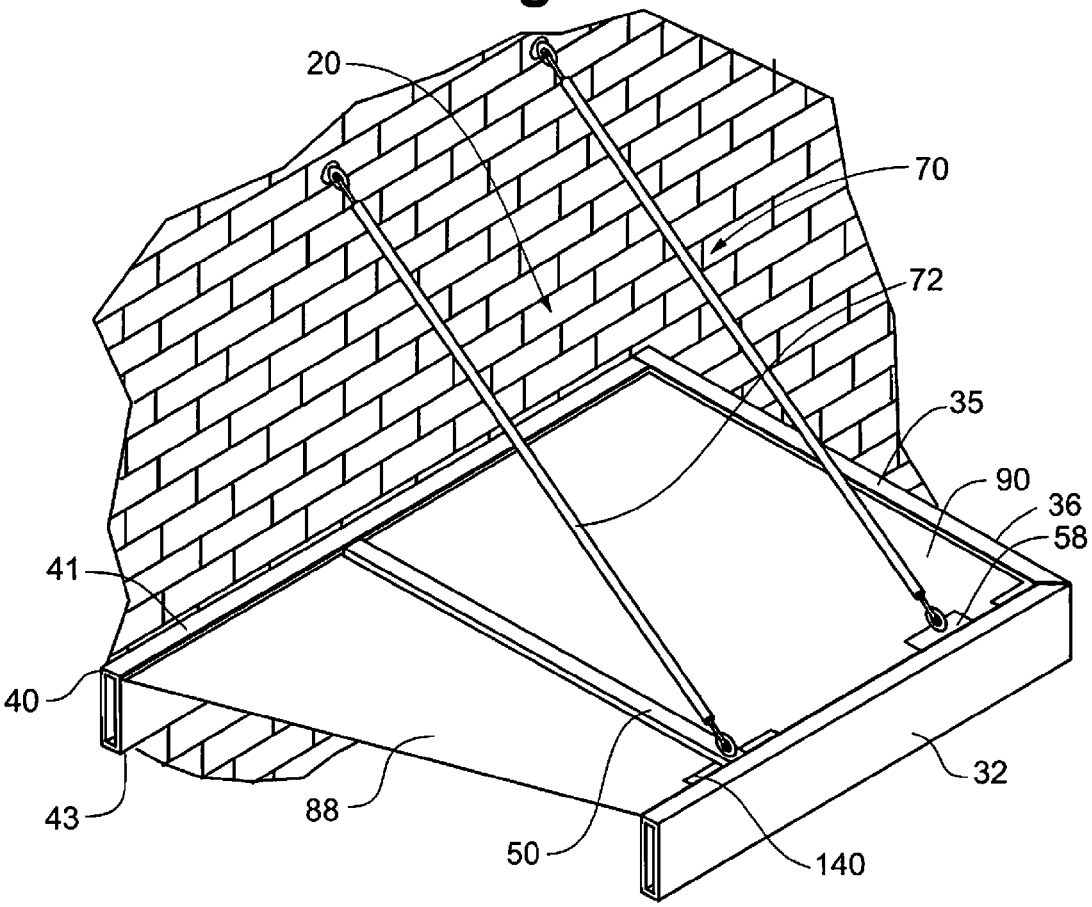
FIG. 3B shows a closer top perspective view of a trellis.
Figure 4:
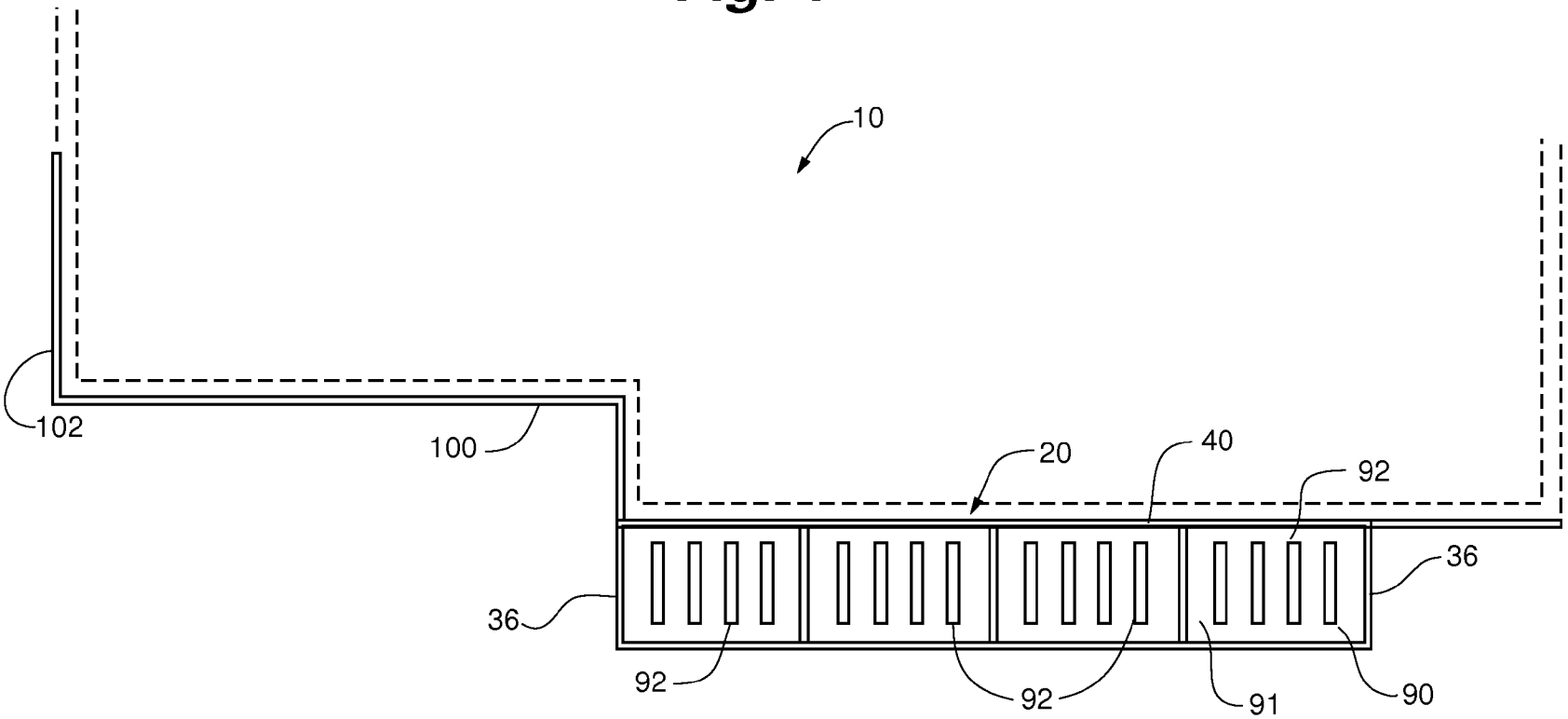
FIG. 4 shows a top planar view of a trellis.
Figure 18:
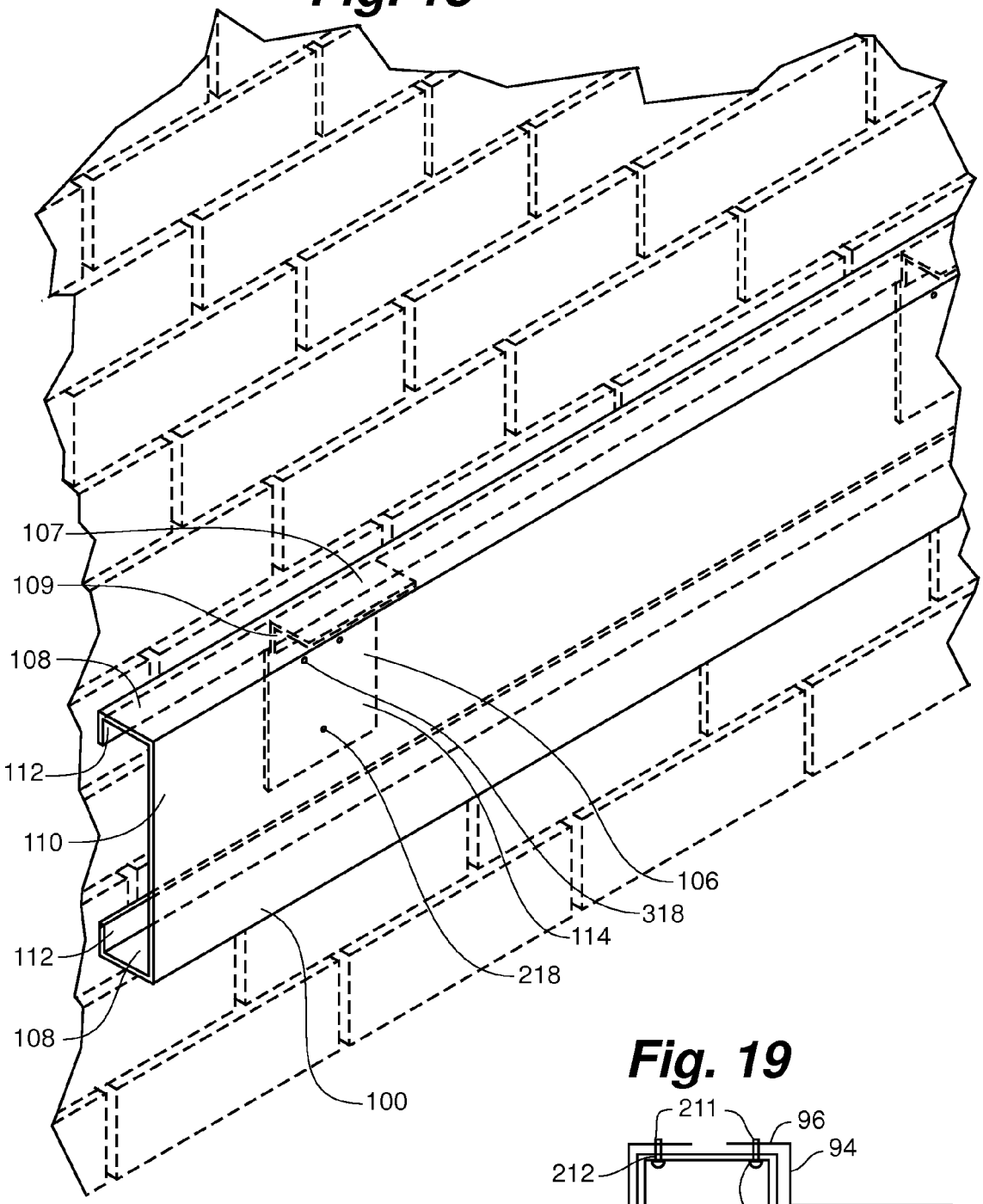
FIG. 18 shows perspective view of a C-shaped accent band attached to a wall.

Referring to FIGS. 3A, 3B, and 4, a trellis system 10 is depicted, wherein the trellis system 10 includes a trellis 20 and accent bands 100. The trellis 20 includes a frame structure 30, in-fill panels 90, cross member assemblies 50, and attachment assemblies 70. The frame structure 30 comprises a fascia or front tube 32, a back tube 40 and end tubes 36. Generally, the front tube 32, back tube 40 and end tubes 36 comprise elongated tubes with a quadrilateral cross-section, and preferably a rectangular cross-section. The accent bands 100 comprise elongated tubes that can be affixed to the side of the building, wherein the accent bands 100, in one embodiment, harmoniously blend with the structure of the trellis. In another embodiment, the accent bands 100 can provide a counterpoint with the trellis, if that is the desired aesthetic appearance. The accent bands 100 also are elongated tubes with a quadrilateral cross-section, and preferably a rectangular cross-section. Alternatively, the accent bands 100 can be C-shaped, as shown in FIG. 18, with a flange 112 extending from each horizontally planar surface 108 edge of the C-shape, the flange substantially orthogonal to the planar surface 108 of the C-shape. In a preferred embodiment, the accent bands 100 are 8 feet long and 2 feet wide.

The components of the trellis 20 are generally made of metal, for example, aluminum or a ferrous alloy. Other materials, for example, plastic, can also be used. Preferably, the trellis 20 is made of aluminum. For example, the front tube 32, back tube 40, end tube 36 and cross member tube 52 are preferably made of extruded aluminum. Using aluminum for other components allows the various components of the trellis 20 to expand and contract together, because of similar/the same coefficient of expansion. However, some of the support components of the trellis 20 can be made of steel for added strength.

Figure 5A:
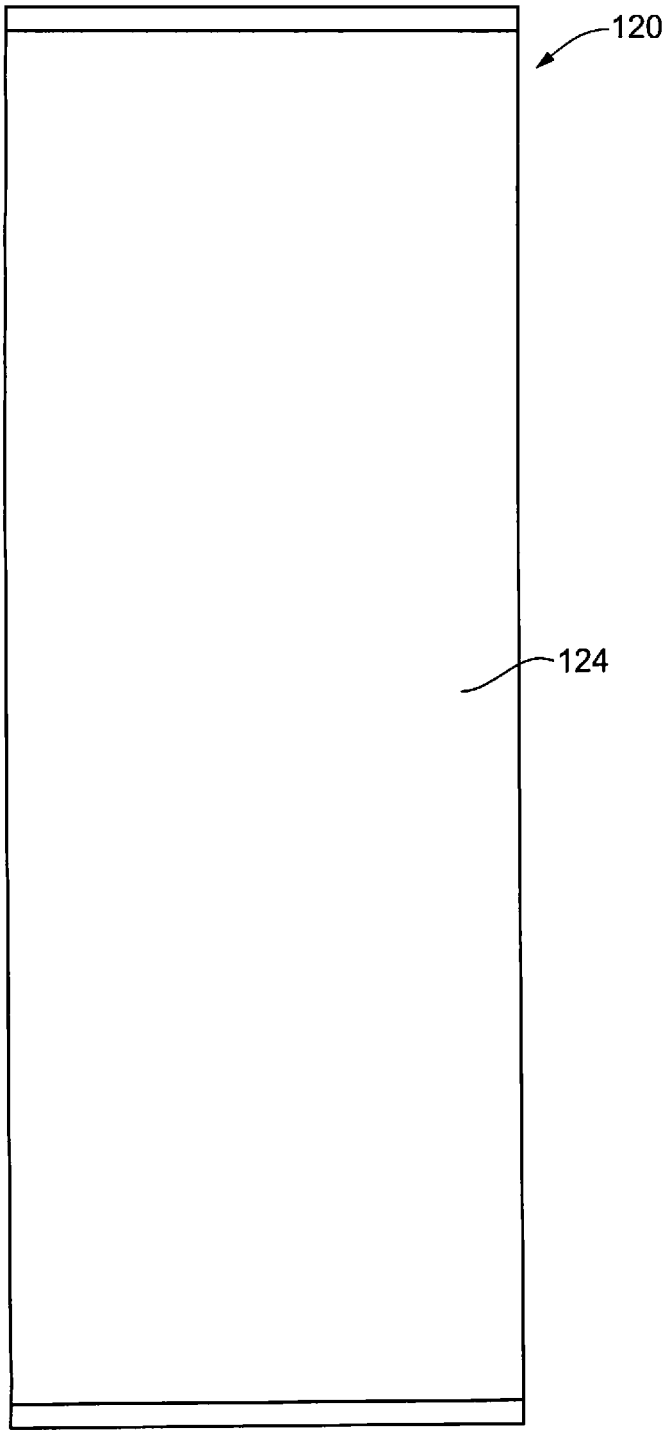
FIGS. 5A and 5B show a back perspective view of a splice sleeve and side perspective view of a splice sleeve.
Figure 5B:
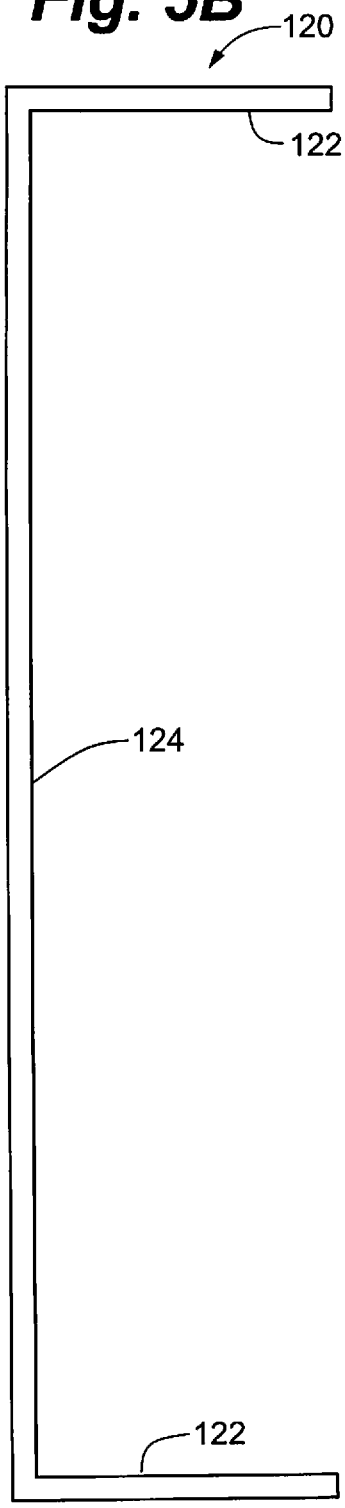
Figure 6:
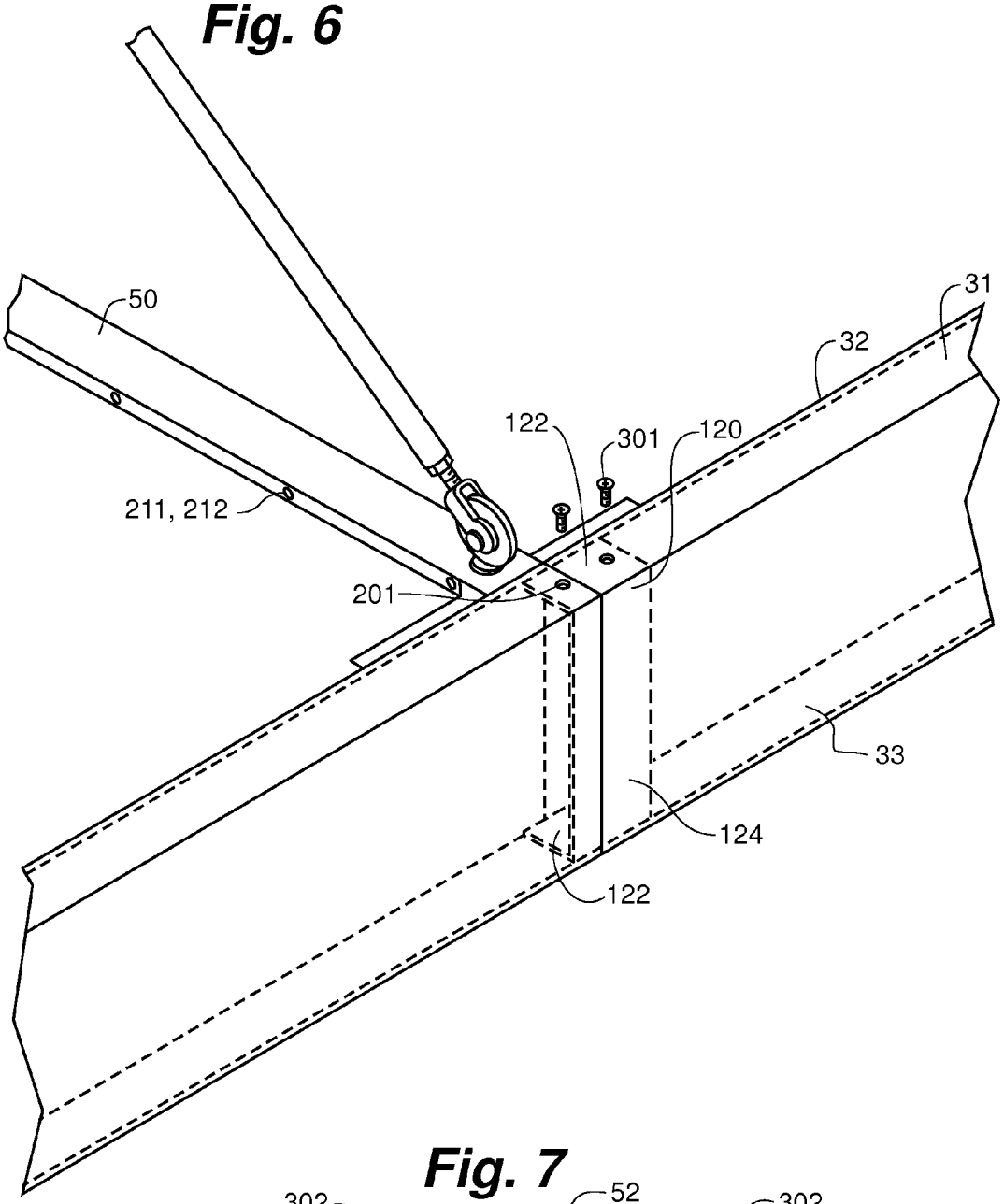
FIG. 6 shows a perspective view of a splice of two front tubes at a cross member with an attached turnbuckle.
Figure 7:
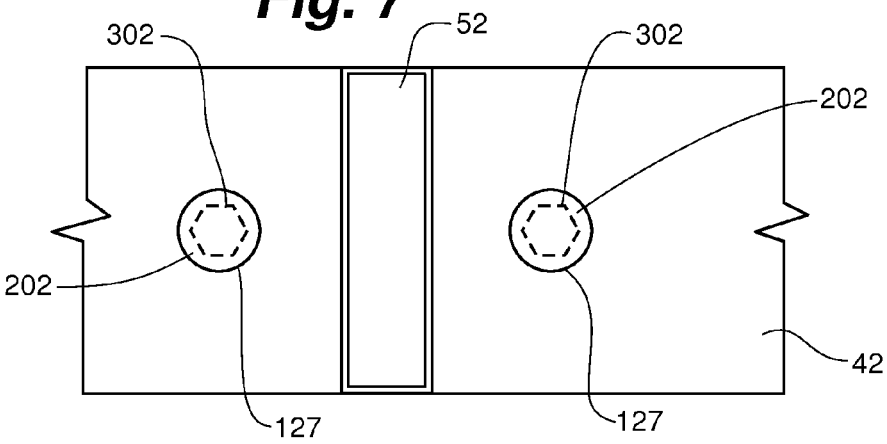
FIG. 7 shows a rear perspective view of a back tube at a junction with a cross member.
Figure 8A:
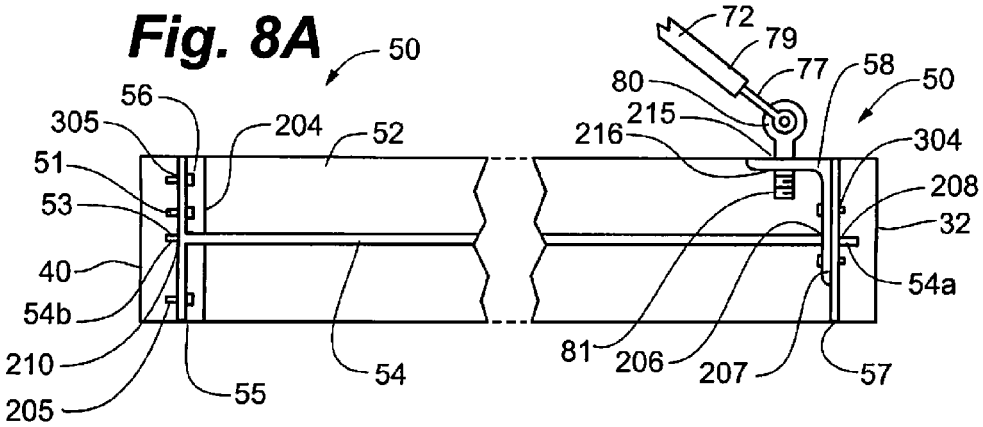
FIG. 8A shows a cross-sectional view of a cross member with the threaded rod.
Figure 8B:
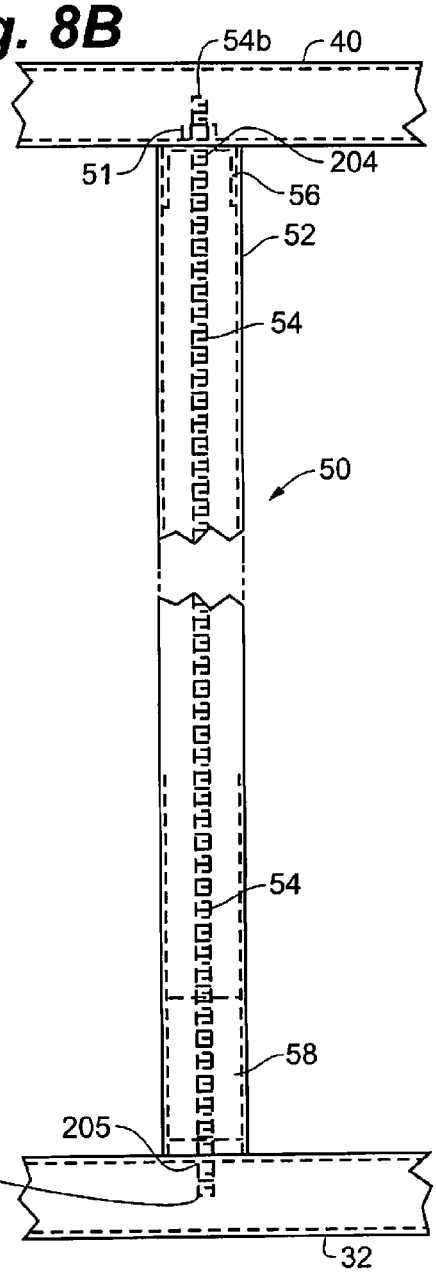
FIG. 8B shows a top planar view of a cross member, with the rod showing.
Figure 8C:
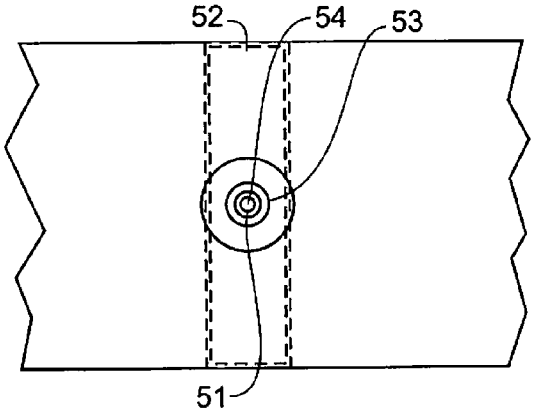
FIG. 8C shows a rear perspective view of the cross member, with the rod end, nut and washer showing.
Figure 9A:
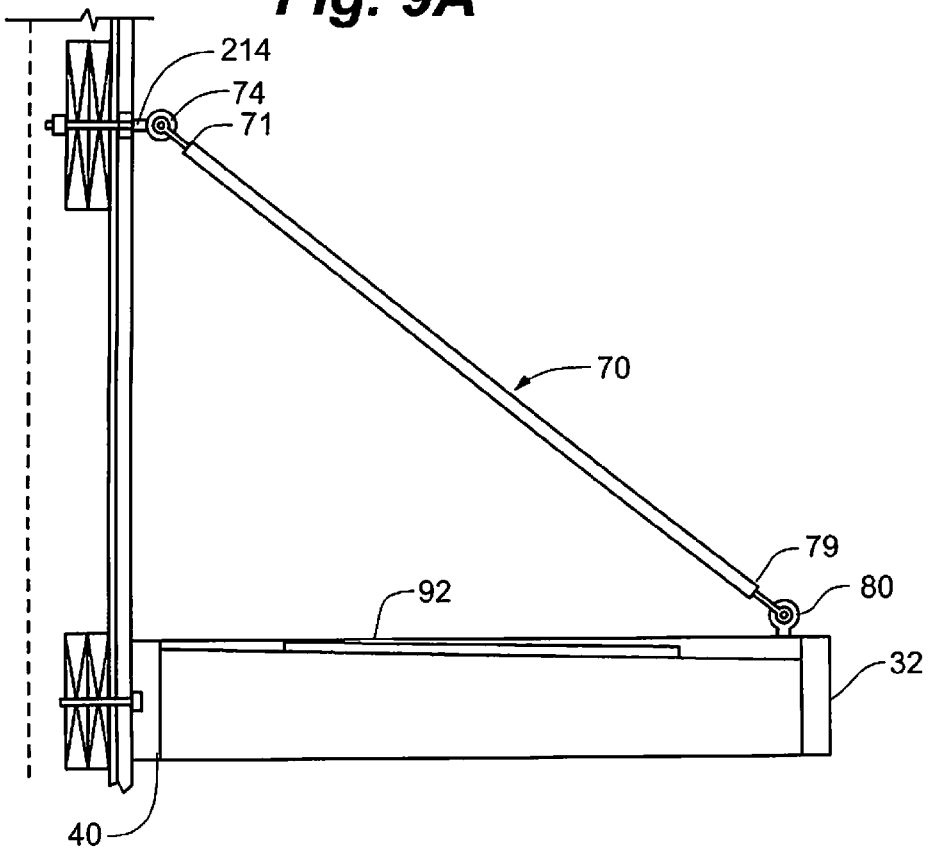
FIG. 9A shows a side perspective view of a trellis, with the turnbuckle attachments showing.
Figure 9B:
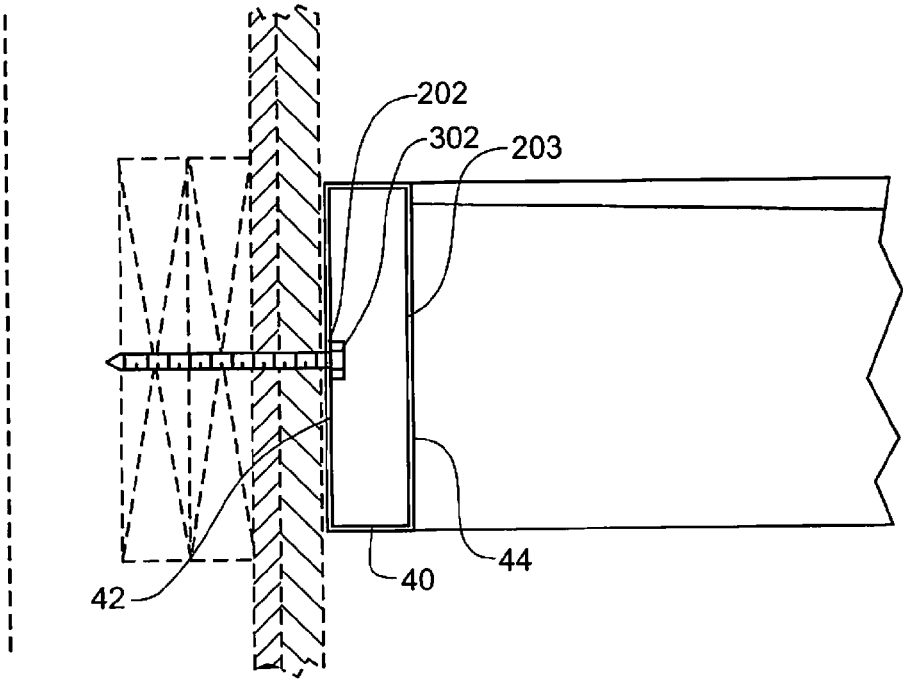
FIG. 9B shows a side perspective of an attachment of the trellis to a wall.
Figure 10:
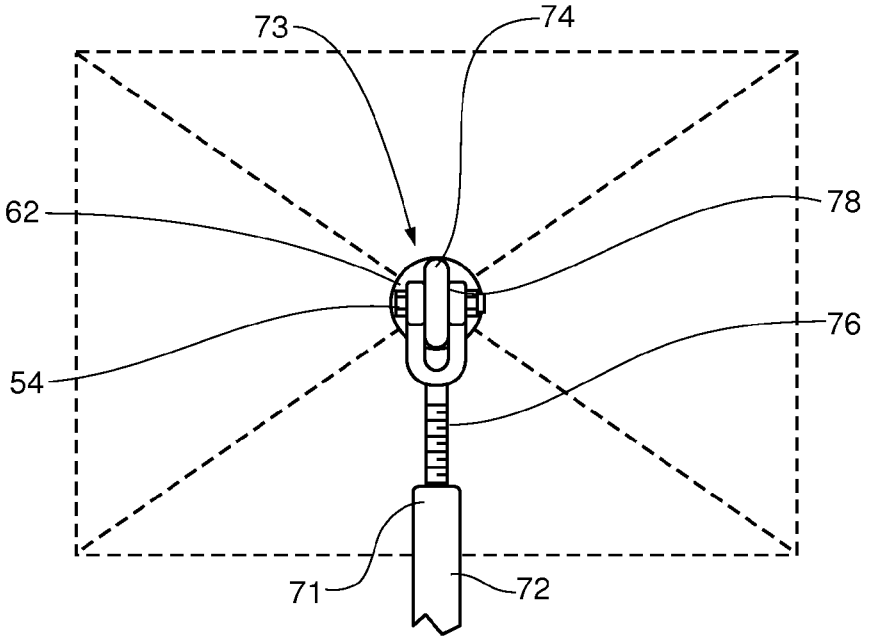
FIG. 10 shows a perspective view of a turnbuckle attachment to a wall.
Figure 11:
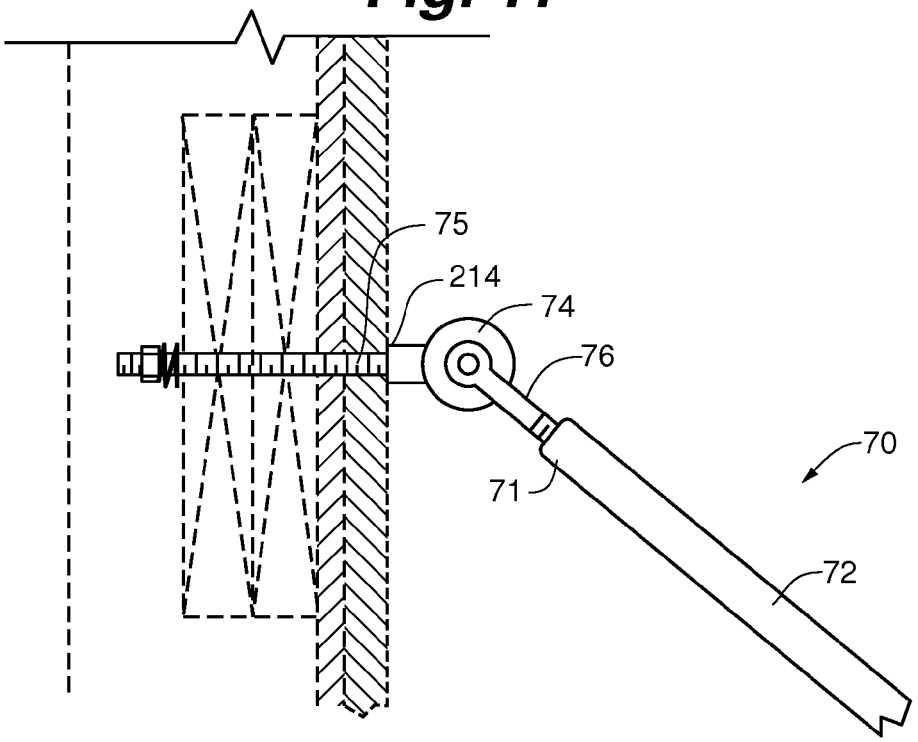
FIG. 11 shows a side perspective view of a turnbuckle attachment to a wall.
Figure 12:
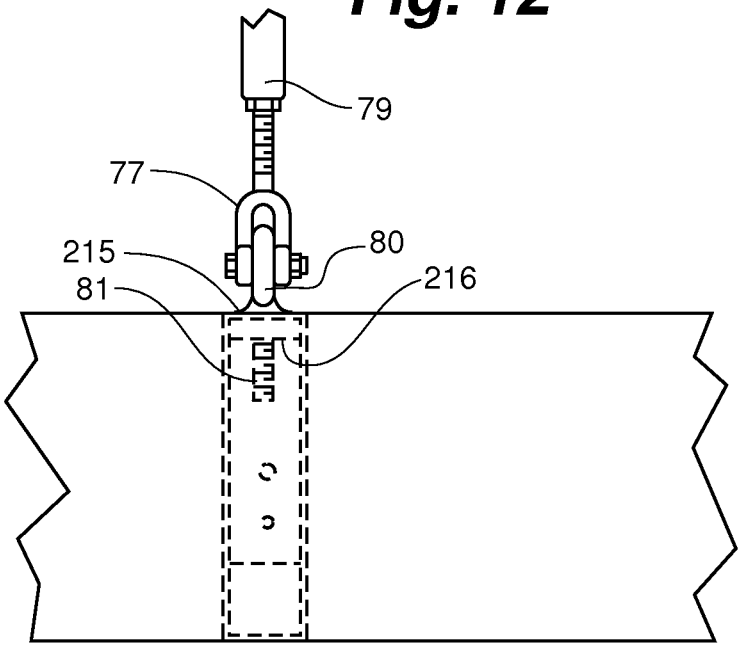
FIG. 12 shows an end perspective view of a turnbuckle attachment to a cross member at the front tube.
Figure 13:
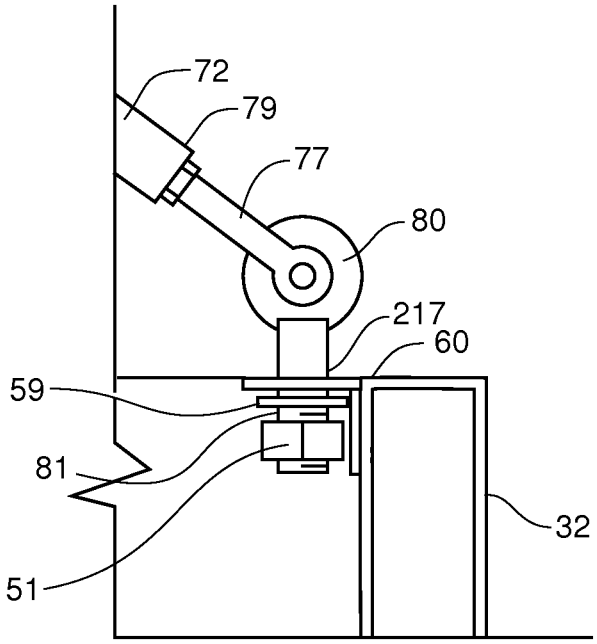
FIG. 13 shows a side perspective view of a turnbuckle attachment to a front tube.

The back tube 40, front tube 32 and end tubes 36 are adapted to interconnect to form a frame 30 encompassing the in-fill panels 90. Generally, the desired frame 30 is rectangular shaped, however a square shape frame can also be constructed. The back tube 40 and the front tube 32 are each constructed from one long tube, respectively, dependent upon the size of the frame 30 required. Front tubes 32 and back tubes 40 are generally fabricated in 24 foot lengths. If longer trellises 20 are needed, then multiple front tubes 32 and multiple back tubes 40 are spliced together to achieve the desired length. Shorter front tubes 32 and back tubes 40 can also be fabricated. Generally, the end tubes 36 are fabricated of sufficient length to not require more than one tube 36 to form the end tube structure. The end portions of the front tube 32, back tube 40, and end tubes 36 are configured to receive a splice sleeve 120. In one embodiment, as shown in FIGS. 5A, 5B, and 6, the splice sleeve 120 is substantially U-shaped, with the two parallel legs 122 connected by a planar segment 124. The splice sleeve 120 is configured to be abuttingly engageable with the interior surfaces of the end portions of a back tube 40, end tube 36 or front tube 32; the legs 122 of the splice sleeve 120 abuttingly engageable with a top 31, 41, 35, and a bottom surface 33, 43, 37, respectively, of a tube. The surface of at least one of the legs 122 of the splice sleeve 120 defines at least two apertures 201, each adapted to receive a fastener 301. The fastener 301 includes, but is not limited to a flat head screw, a rivet, a weld, but preferably a flat head screw. The back tube 40 further defines a plurality of apertures 202 in the distal back tube surface 42 adapted to receive fasteners 302, and a plurality of apertures 203 in the back tube proximate surface 44 adapted to receive a tool, for example, a ratchet wrench. A distal tube surface refers to the exterior surfaces of the tube, facing a building or on the exterior of the trellis 20; a proximate tube surface refers to an internal surface of a tube, facing the in-fill panels 90.

As shown in FIGS. 3A, 3B, 4, 8A, 8B, and 8C, the trellis 20 comprises a plurality of cross member assemblies 50; however, only one of the cross member assemblies 50 is described, as the other cross member assemblies 50 are similar in structure. The cross member assembly 50 includes a tube 52, a threaded rod 54, a channel shear block 56, a nut 51 and washer 53, and a support angle 58. The threaded rod 54 extends through the interior of the cross member tube 52, the length of the cross member tube 52. Preferably, a cross-section of the cross member tube 52 is rectangular shaped, however other quadrilateral shapes can be used to accommodate surrounding geometry. The interior of the cross member tube 52 is adapted to receive a channel shear block 56 at one end 55 portion of the cross member tube 52 and a support angle 58 at the other end portion 57 of the cross member tube 52. The channel shear block 56 and the support angle 58 each define at least two apertures 204, 206 and 205, 206, in a surface of the channel shear block 56 and in a surface of the support angle 58, respectively, wherein one aperture 204, 206 is adapted to receive an end of the threaded rod 54 and the second aperture 205, 207 is adapted to receive a fastener 305, 307. Fasteners 305, 307 include, but are not limited to a flat head screw, a rivet, a weld, a Phillips pan head self drilling fastener, a hex head self-threading fastener, and the like. Preferably fastener 305 is a Phillips pan head self-drilling fastener and fastener 307 is a hex head self-threading fastener. One end 55 of the cross member 50 is abuttingly engageable with the back tube 40 and the opposite end 57 of the cross member 50 is abuttingly engageable with the front tube 32. Further, an aperture 208 in the proximate surface of the front tube 32 is configured to receive a first end of the threaded rod 54*a*, and an aperture 210 in the proximate surface of the back tube 40 is configured to receive a second end 54*b* of the threaded rod. A securing device, for example, a nut 51 and washer 53, is engageable with end of the threaded rod end 54*b* proximate the back tube 40.

Figure 14:
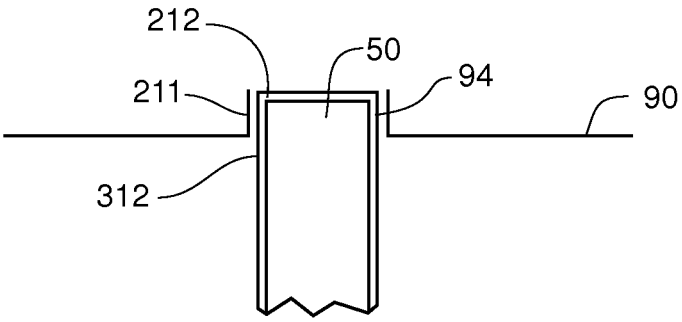
FIG. 14 shows an end perspective view of an in-fill panel attached to a cross member.
Figure 19:
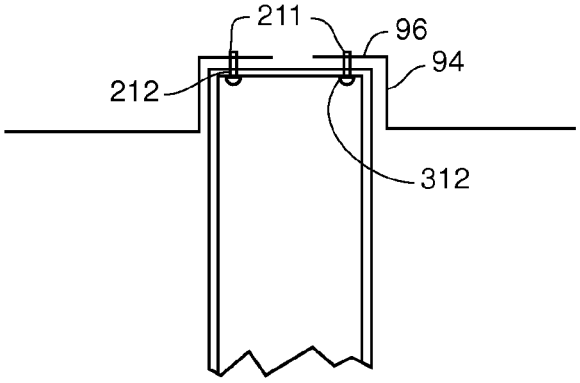
FIG. 19 shows a perspective view of an alternative structure and joining of an in-fill panel to a cross member.
Figure 20:
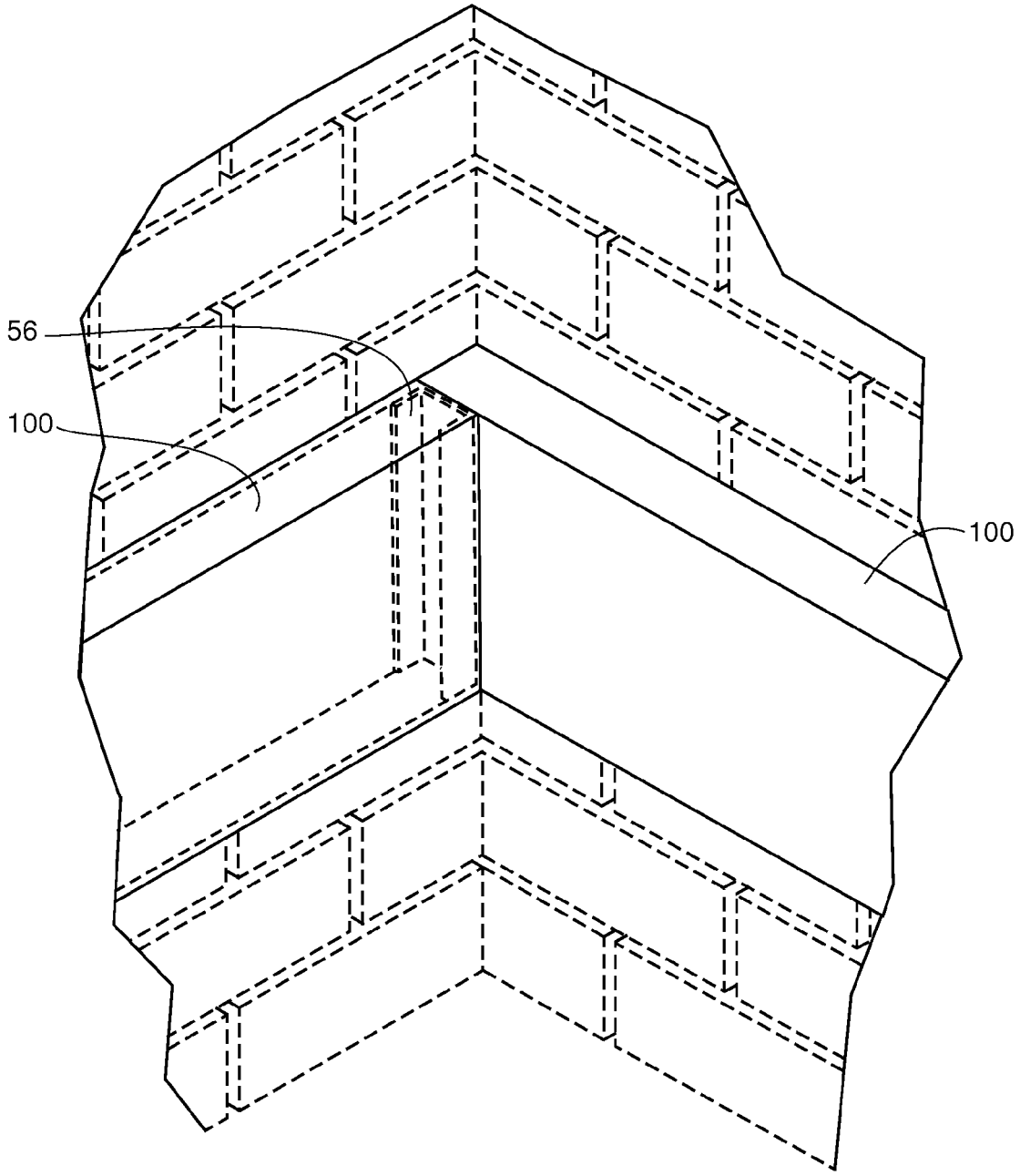
FIG. 20 shows a perspective view of two accent bands joined at a building interior corner.
Figure 21:
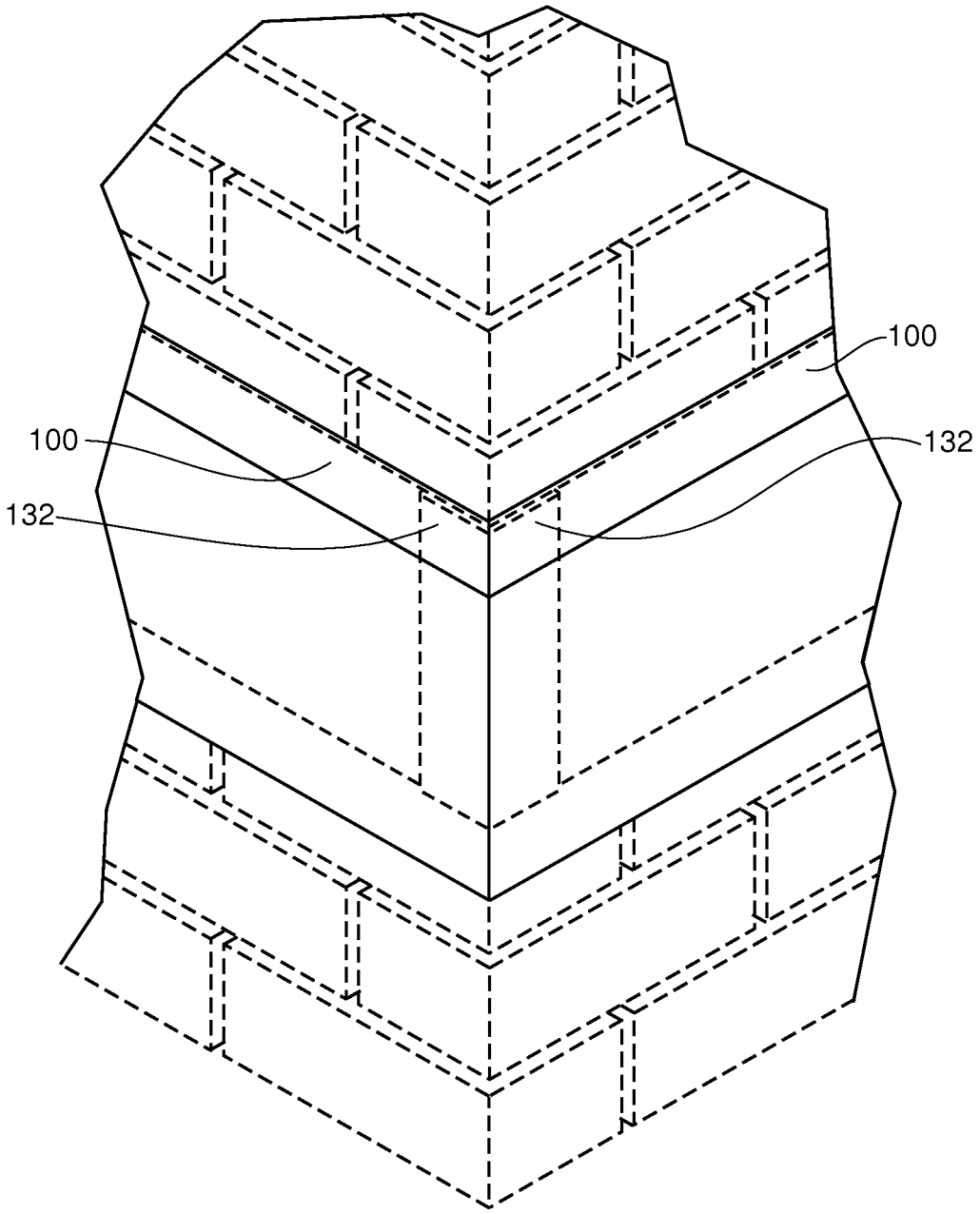
FIG. 21 shows a perspective view of two accent bands joined at a building exterior corner.
Figure 22:
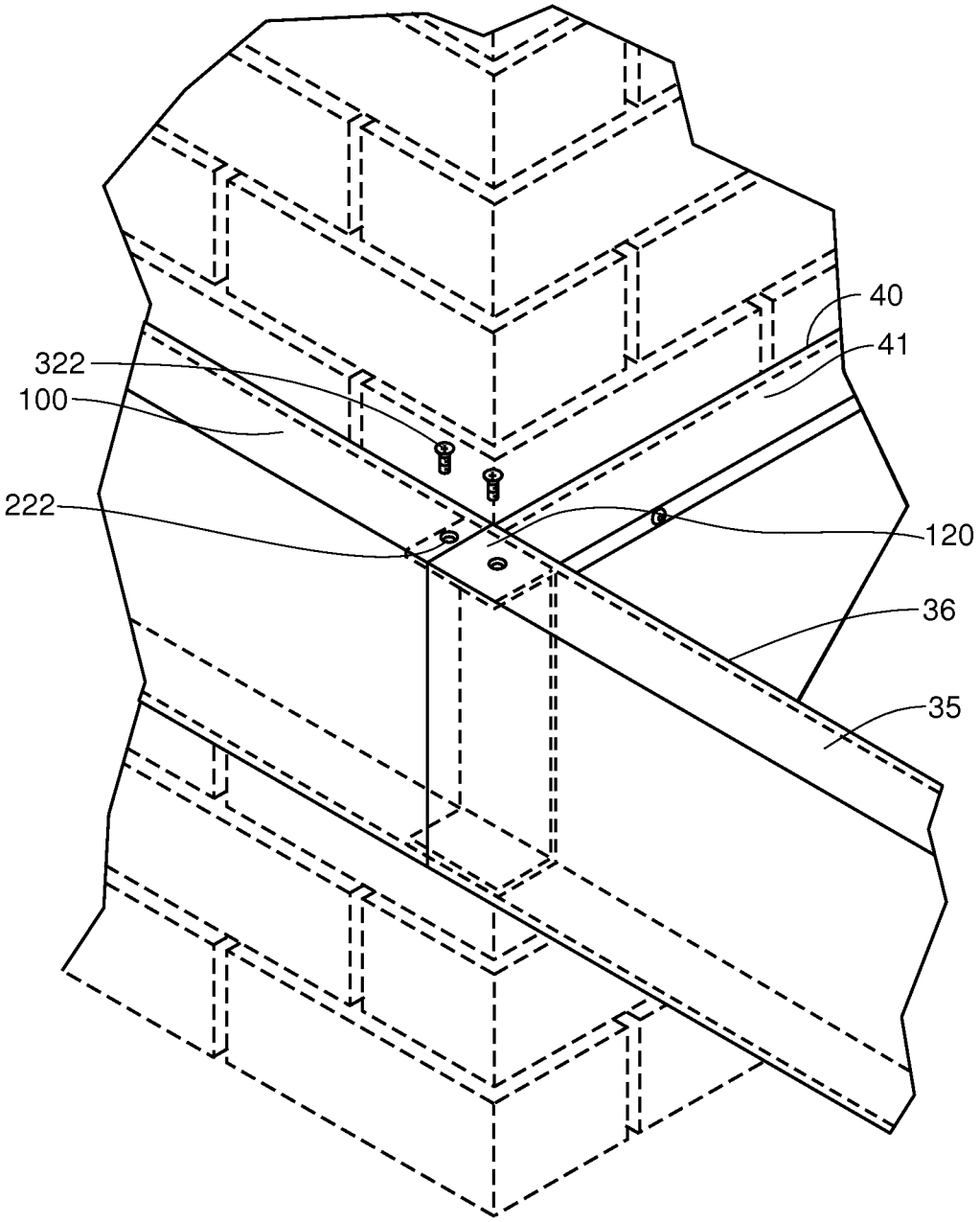
FIG. 22 shows a perspective view of a joining of an accent band, back tube, and end tube, at a building corner.

Referring to FIGS. 3B, 14 and 19, the roof 88 of the trellis 20 is formed by in-fill panels 90 which are affixed to the frame work 30 of the back tube 40, the front tube 32 and the end tubes 36. The in-fill panels 90 are also affixed to the cross members 50. Each in-fill panel 90 includes a lip or flange structure 94 along the perimeter of the in-fill panel 90. The flange structure 94 defines a plurality of apertures 211 configured to align with apertures 212 drilled in the proximate surfaces of the tube 32, 40, 36 and cross members 50 such that the aligned apertures 211, 212 are positioned to receive fasteners 312. The fasteners 312 can be rivets, nails, screws, welds, or the like. Preferably, flat head screws or rivets are used. Alternatively, the in-fill panel 90 perimeter can include a lip or flange 94 connected to a horizontal leg 96, the horizontal leg 96 parallel to the in-fill panel 90, such that the horizontal leg 96 is abuttingly engageable and adapted to be affixed to the top surface of the cross member 50 and to the top surface 31, 41, 37, of the front tube 32, back tube 40 and end tubes 36. The fasteners 312 affixing the in-fill panels 90 to the cross members 50 and to the tubes 32, 40, 36 are not visible from below the trellis 20.

As shown in FIGS. 3A and 4, the top surface 91 of the in-fill panels 90 includes a plurality of spaced stiffeners 92. The stiffeners 92 are oriented parallel to the cross members 50, in between the cross members 50. The stiffeners 92 can be variously shaped. In a preferred embodiment, the stiffeners 92 are shaped hat channels 93, wherein the horizontally planar portion 96 of the hat channel 93 is preferably adhered to the top surface 91 of the in-fill panel 90. Preferably, the planar portion 96 of the hat channel 93 is adhered to the top surface 91 of the in-fill panel 90, with an industrial adhesive. The addition of stiffeners 92 is optional, and is generally added to trellises in northern and coastal regions that must withstand the weight of snow and/or updrafts.

Referring to FIGS. 3B, 8A, 9A, 10, 11, 12, and 13, the attachment assembly 70 comprises a turnbuckle 70 that includes a metal pipe 72, a shoulder eyebolt 74 coupled to a left-handed threaded jaw 76, wherein the left-handed threaded jaw 76 is threadingly engaged with a first end portion 71 of the metal pipe 72. Preferably, the metal pipe 72 is a steel metal pipe 72, preferably a galvanized or painted steel pipe. The shoulder eyebolt coupling 73 with the left-handed threaded jaw 76 includes a rubber spacer 78 such that any noise caused by the interaction of the eyebolt 74 and the left-handed threaded jaw 76 is reduced. The eyebolt 74 is configured to be received in an aperture 214 drilled through the building surface and affixed to the underlying structure of the building. The turnbuckle 70 further includes a right-handed jaw 77 threadingly engaged to the second portion 79 of the steel pipe opposite the first end portion 71. An eyebolt 80 is adapted to receive the right-hand threaded jaw 77, the eyebolt 80 presenting a shaft 81 engageable with a top surface of the trellis 20. In one alternative, the eyebolt shaft 81 is coupled to a cross member 50, wherein an aperture 215 in the cross member 50 is aligned with an aperture 216 in a support angle 58 positioned in the interior of the cross member 50, and the apertures 215, 216 are configured to receive the threaded shaft 81 of the eyebolt 80. Further, the support angle 58 includes at least one other aperture 207, the aperture 207 configured to receive a fastener 307 affixing the support angle 58 to the proximate surface of the front tube 32. Fastener 307 includes, but is not limited to a flat head screw, a rivet, a weld, a hex head self-threading fastener, and the like. Preferably fastener 307 is a hex head self-threading fastener. In another alternative, the in-fill panel 90 includes a plate on the top surface of the in-fill panel 90, the plate defining an aperture 217 configured to receive the threaded shaft 81 of the eyebolt 80. Here, too, a support angle 58 is positioned on the proximate surface of the front tube 32.

Figure 17:
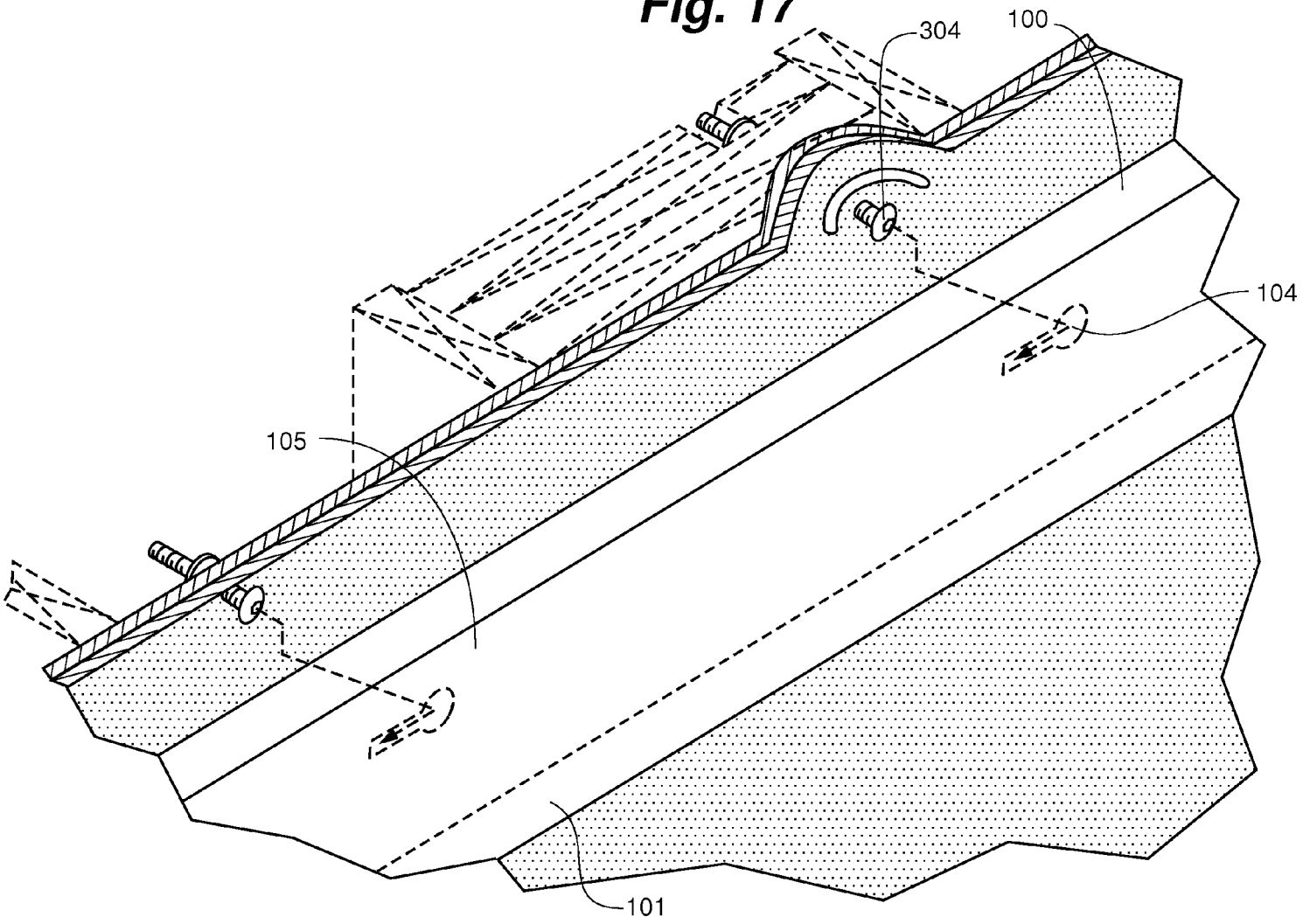
FIG. 17 shows a perspective view of an accent band and keyhole attachment.

The accent bands 100 comprise a plurality of bands 100 designed to provide an aesthetically pleasing finished appearance to the building exterior, proximate the installed trellis 20. One or a plurality of accent bands 100 can be used, dependent upon the given circumstances of, for example, design and size of the building, as demonstrated in FIGS. 3A and 4. An accent band 100 comprises a tube 101, generally with a rectangular cross-section; however, other quadrilateral shapes can be used, dependent, at least in part, on surrounding geometries. Referring to FIG. 17, the distal face 105 of the tube 100 includes a plurality of keyhole slots 104 adapted to receive the head of a fastener 304 affixed to the wall of the side of the building. The fastener 304 affixed to the side of the building can include, but not be limited to, a screw, a nail, a bolt, or a weld. Preferably the fastener 304 is a carriage bolt or the like. Alternatively, the accent band 100 can have a C-shaped cross-section, with two parallel legs 108 connected to one another by a planar segment 110, as shown in FIG. 18. The two legs 108 further include a flange 112, wherein the flange portion 112 is positioned parallel to the planar segment 110, the two flange portions 112 extending toward each other. The accent band 100 further includes an anchor plate 106 positioned in the interior of the accent band 100, a horizontal top segment 107 of the anchor plate 106 abuttingly engageable with the top leg 108 of the accent band 100, and an orthogonally contiguous segment 109 of the anchor plate 106 abuttingly engageable with the top flange 112 of the anchor band 100. The orthogonal contiguous segment 109 of the anchor plate 106 forms a lip 111 and a lower portion 114 of the anchor plate extends substantially orthogonally to the lip 111. The lower portion 114 of the anchor plate 106 is configured to be positioned flush against the wall of the side of the building and defines at least one aperture 218 adapted to receive a fastener 318 and affix the anchor plate 106 to the wall of the building. The fastener 318 includes, but is not limited to a screw, a bolt, a nail, a weld, or a rivet; and is preferably a wood screw. Other configurations for an anchor plate 106 can be used with the accent band 100, the anchor plate 106 designed to accommodate the shape of the accent band 100.

Figure 23:
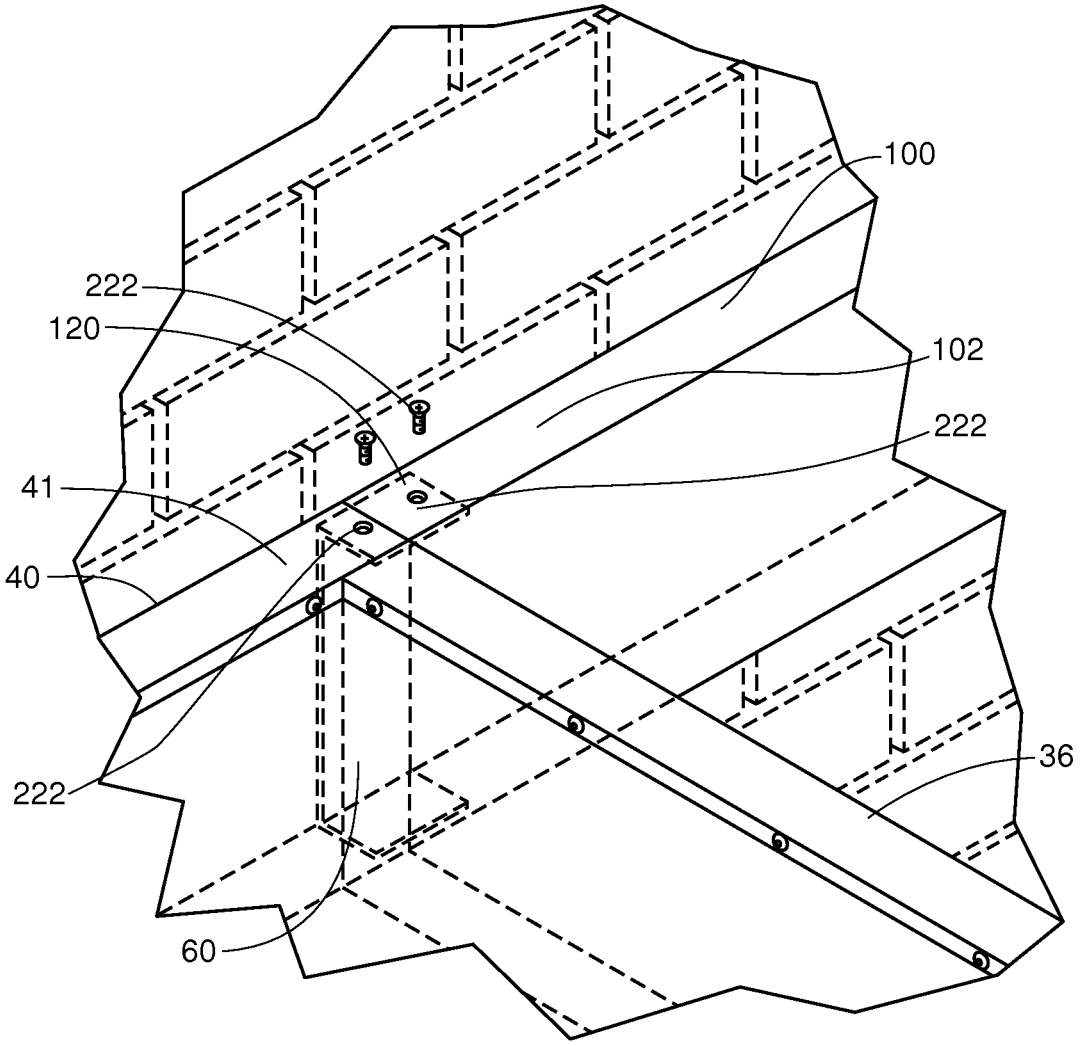
FIG. 23 shows a perspective view of a joining of an accent band and end tube.

The accent bands 100 can be linked together with each other, along the walls of the building, and can also be linked with the back tube 40 and/or the end tubes 36, dependent upon the final configuration of the trellis system 10. FIGS. 20-23 show various connections of accent bands and, in some instances, a back tube 40 and end tube 36. Using a splice sleeve 120, as described above, the accent bands 100 can be spliced to one another, to the back tube 40 and/or the end tubes 36, resulting in a hairline joint. An example of a splice of the back tube 40 and an accent band 100 is shown in FIG. 23. For turning corners, a shear block 56 can be affixed to a first accent band 100, and the second accent band 100 fits over the shear block, the second accent band 100 positioned orthogonally to the first accent band 100.

The trellis 20 can be preassembled away from the installation site, or the trellis 20 can be assembled on site. Generally the trellis is assembled by joining a plurality of in-fill panels 90, a back tube 40, a front tube 32, end tubes 36, cross members 50, and attachment assemblies 70. Pre-assembling the trellis 20 away from the installation site is generally more cost efficient and time efficient, because, for one reason, the same crew can gain experience in assembling the trellis 20 and has the required tools at hand. The in-fill panel sections 90 generally come in 4 ft.×6 ft. sections and the final length of the trellis 20 is generally 24 ft. However, the in-fill panels 90 and the trellis 20 can be fabricated in other sizes. The 4 ft.×6 ft. in-fill panels, with a total trellis length of 24 ft., are presented as an example. A further example of a 48 ft. trellis 20 is presented to illustrate splicing two sections of the trellis 20 together, forming one hairline joint.

Figure 24:
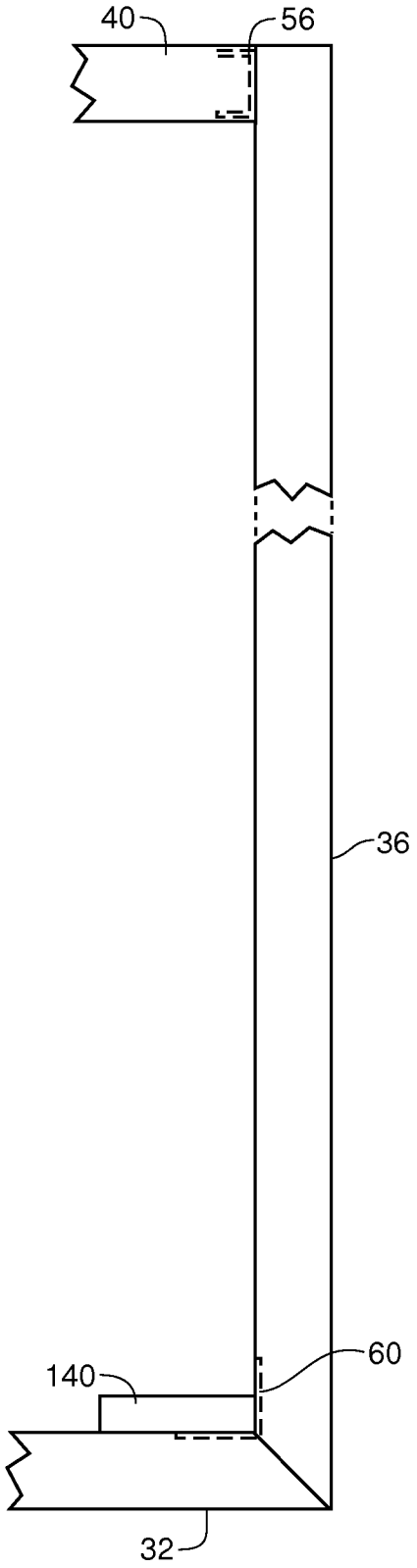
FIG. 24 shows a top planar view of the junction of the back tube with an end tube, and a front tube with an end tube.

In operation, a back tube 40 is attached to a first end of an end tube 36 of the trellis 20 and a front tube 32 is attached to a second end of an end tube 36 of the trellis 20, as shown if FIG. 24. In this example, the front tube 32 and the back tube 40 are each 24 feet long. A shear block 56 is affixed to an end surface of the back tube 40 and the first end of the end tube 36 is slidingly engaged over the shear block 56 and the end tube is affixed to the shear block 56 by fasteners 318. The fasteners 318 are metal fasteners 318, for example, rivets, bolts, nails, screws, or a weld. Preferably, the fasteners 318 are flat head screws. The second end of the end tube 36 is affixed to an angle plate 60, wherein one leg of the angle plate 60 abuts the interior surface of the proximate face of the end tube 32 and the other leg of the angle plate 60 abuts the interior surface of the proximate face 34 of the front tube 32. The angle plate 60 is fastened to the front tube 32 and the end tube 36 using fasteners 320. The fasteners 320 are metal fasteners 320, for example, rivets, bolts, nails, screws, or a weld. Preferably, the fasteners 320 are flat head screws. A hairline joint is formed between the back tube 40 and end tube 36, and the front tube 32 and end tube 36, and no fasteners 318, 320 are visible on the exterior surfaces of the trellis 20.

A first end 55 of a cross member 50 is affixed to the back tube 40 and a second end 57 of the cross member 50 is affixed to the front tube 32. A first end 54*b* of the threaded rod 54 in the first end 55 of the cross member 50 extends through a shear block plate 56 and then into the back tube 40 interior. A nut 51 and washer 53 are threaded on the end of the threaded rod 54*b*. A second end 54*a* of the threaded rod 54 extends through an angle plate 58 and into the front tube 32 interior. When the trellis 20 structure is complete, the nut 51 on the threaded rod 54 is tightened, thereby fixing the front tube 32 and back tube 40 together. Access to the nut 51 is gained through apertures 202 in the distal face 42 of the back tube 40.

The turnbuckles 70 are affixed to the trellis 20 either through a plate affixed to the surface of an in-fill panel 90 or to a cross member 50. The shoulder eyebolt 80 at one end 79 of the turnbuckle 70 is threaded through an angle plate 58 in the interior of the cross member 50. A lock washer 59 and nut 51 are threaded onto the eyebolt shaft 81 and tightened, thereby fixing the eyebolt 80 in place. Alternatively, the shoulder eyebolt 80 is affixed to a plate on the surface 91 of an in-fill panel 90. And angle plate 60 is affixed to the proximate surface of a front tube 32. A lock washer 59 and a nut 51 are threaded onto the eyebolt shaft 81 and tightened, thereby fixing the eyebolt 80 in place. Thread lock can be used on the threads. The opposite end 71 of the turnbuckle 70 is not affixed to the building wall until the trellis 20 is completed.

A plurality of stiffeners 92, in particular, hat channels 93, is adhered to each in-fill panel 90, using an industrial adhesive. Such adhesives are available from various adhesive companies, for example, Lord Corporation of North Carolina. In a preferred embodiment, four hat channels 93 are spaced apart and adhered to the top surface 91 of an in-fill panel 90. The hat channel 93 generally does not extend the entire width of the in-fill panel 90.

Figure 15:
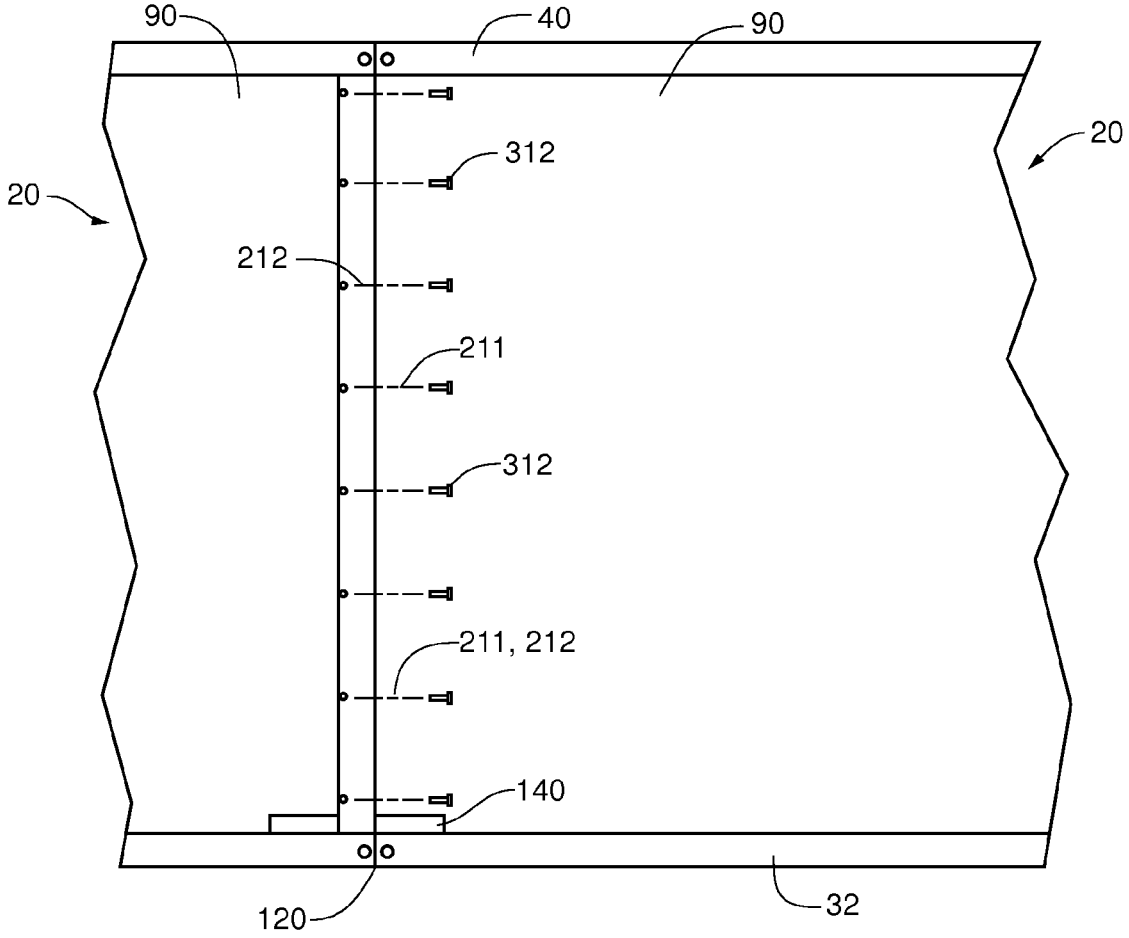
FIG. 15 shows a top planar perspective of two trellis panels spliced together at a cross member.
Figure 16:
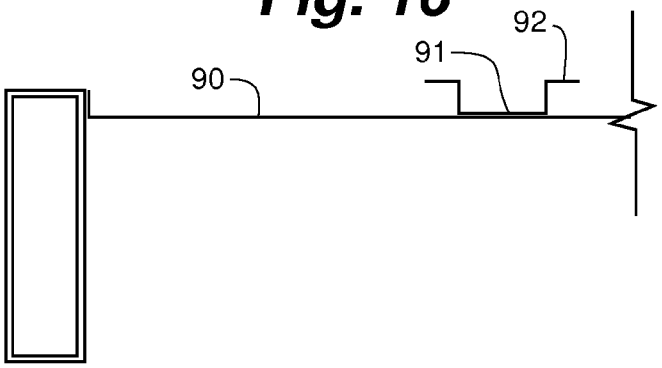
FIG. 16 shows an end perspective view of a hat channel adhered to an in-fill panel.

The in-fill panel 90 is affixed to the front tube 32, back tube 40, cross member 50 and end tube 36, if the in-fill panel 90 is an end panel. The lip 111 of the perimeter of the in-fill panel 90 abuttingly engages the inner (proximate) surfaces of the front tube 32, back tube 40, end tube 36 and cross member 50, and fasteners 312 are used to affix the in-fill panel lip 111 to the front tube 32, back tube 40, end tube 32 and cross member 50. Metals fasteners 312, for example, screws, bolts, welds, rivets, can be used, and preferably flat head screws or rivets are used to affix the in-fill panel 90. Each in-fill panel 90 is similarly affixed to the front tube 32, back tube 40 and cross member 50, the length of the trellis 20. If a longer trellis 20 is required, beyond the longest standard length, for example, longer than 24 feet, two pre-assembled segments of the trellis 20 are mated to obtain the longer length, as shown in FIG. 15. Two sections of the trellis 20 are brought together forming a hairline joint. A trellis splice sleeve 120 is fastened to the two segments of the trellis 20; one splice sleeve 120 joining the two front tubes 32, and one splice sleeve joining the two back tubes 40. Using the apertures 211 in the in-fill panel 90 as a guide, holes are drilled in the cross member tube 52 of a first section of trellis 20 and the in-fill panel 90 of the second section of trellis 20 is affixed to the cross member tube 52 of the first section of trellis 20. Only a hairline joint shows in the exterior of the trellis.

Once the in-fill panels 90 are affixed to the back tube 40, front tube 32, cross members 50, and end tubes 36 when an end panel, the unattached end 71 of the turnbuckle 70 can be affixed to the building. The shaft 75 of the eyebolt 74 is inserted through an aperture 214 drilled into the wall. The shaft 75 of the eyebolt 74 is passed into the aperture 214, to the wood blocking of the wall. A flat washer 62 and lock washer 59 and nut 51 are threaded on the end of the eyebolt shaft 75 and the second end 71 of the turnbuckle 70 is affixed to the building. The left jaw 76 and right jaw 77 structure of the turnbuckle 70 facilitates turning the turnbuckle 70 to the right or to the left to level the trellis 20, lifting or lowering the trellis structure.

Accent bands 100 can be added to the building exterior to complete an aesthetically pleasing appearance. An accent band 100 added to the building face adjacent the back tube 40 is connected to the back tube 40 by a splice sleeve 120, wherein the fastener 322 is positioned at the top 102 of the accent band 100/back tube 41 surfaces. A fastener 322, for example, a flat head screw, passes through aperture 222, and is used to fasten the accent band 100 and the back tube 40 to the splice sleeve 120. The fastener 322 can include, but not be limited to a bolt, screw, weld, or rivet. Further, the end tube 36 abuts to the hairline joint formed by the accent band 100 and back tube 40. An angle plate 132 connects two accent bands 100 around a corner of the building. One leg of the plate 132 abuts along the interior of the distal face of one accent band 100, and the other leg of the plate abuts along the interior of the distal face of the other accent band 100, and the fasteners affix each band 100 to the angle plate 132, such that the fasteners are not visible on the exterior of the accent bands.

As shown in FIG. 17, keyhole slots 104 positioned in the distal surface 105 of the accent band 100 are positioned over a fastener head 304, for example, a carriage bolt head, the bolt extending from the exterior of the building wall into the interior of the wall. A flat washer 62, lock washer 59 and nut 51 secure the carriage bolt to the building. Alternatively, the accent band 100 is affixed to the building exterior by use of an anchor plate 106. The anchor plate 106 is affixed to the exterior building wall by fasteners 318, for example, wood screws, and the accent band 100 is hung over an extending lip 107 of the anchor plate 106. The accent band 100 used with the anchor plate 106 is not a tube, but C-shaped with a flange 112 at each horizontal end 108 of the C-shape.

In another embodiment of the present invention, referring generally to FIGS. 25-35, a trellis system 400 is depicted. Trellis system 400 includes a trellis 402 and accent bands 404. Trellis 402 includes attachment assemblies 408 and a frame structure 30, cross member assemblies 50, and in-fill panels 90 as described in previous embodiments. Frame structure 30 comprises a fascia or front tube 32, a back tube 40 and end tubes 36, just as described in previous embodiments. In-fill panels 90 are operably coupled to cross member assemblies 50 as described in previous embodiments. Further, frame 30 encompasses in-fill panels 90 as described in previous embodiments.

Figure 25:
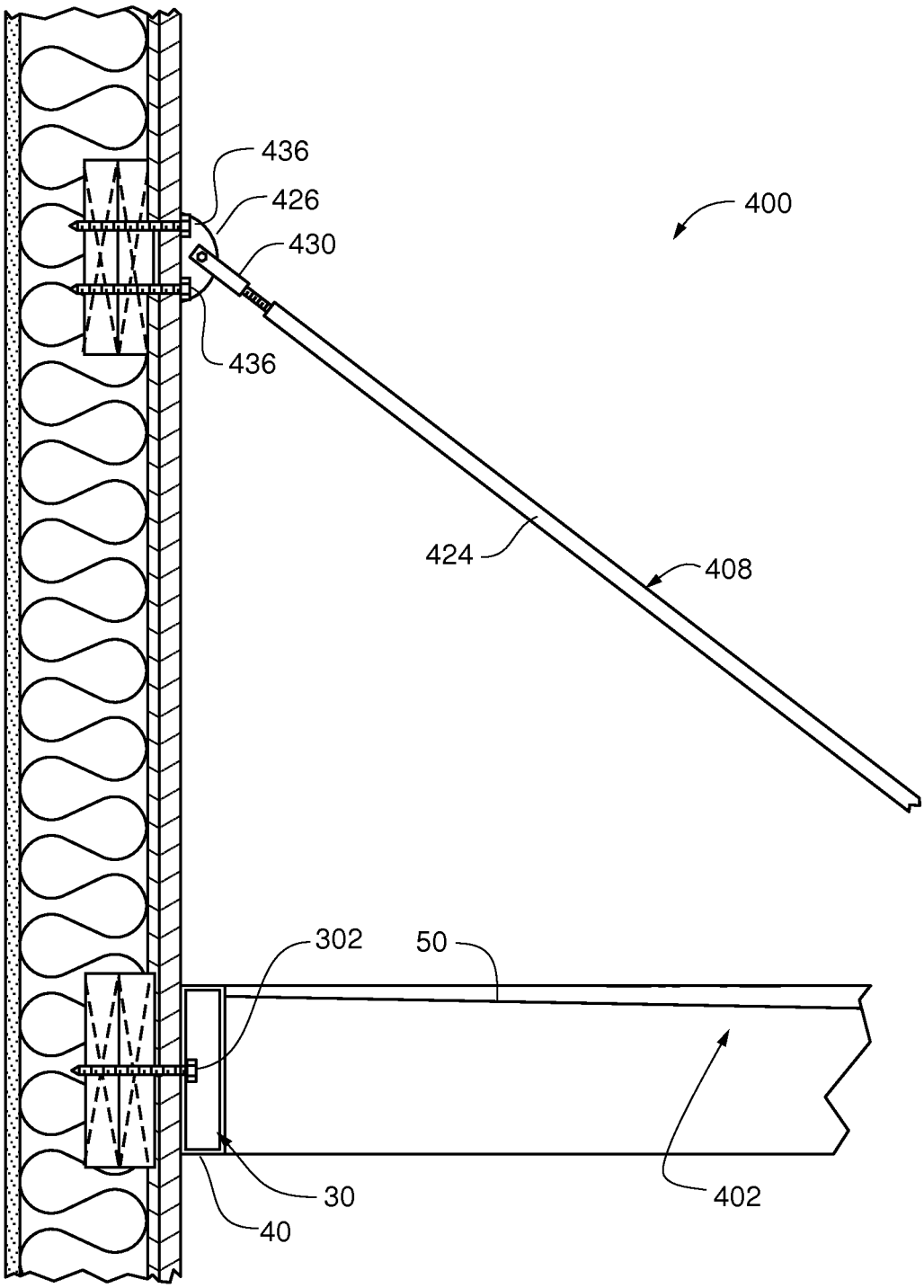
FIG. 25 shows a side perspective view of a trellis, according to an embodiment of the invention.
Figure 26:
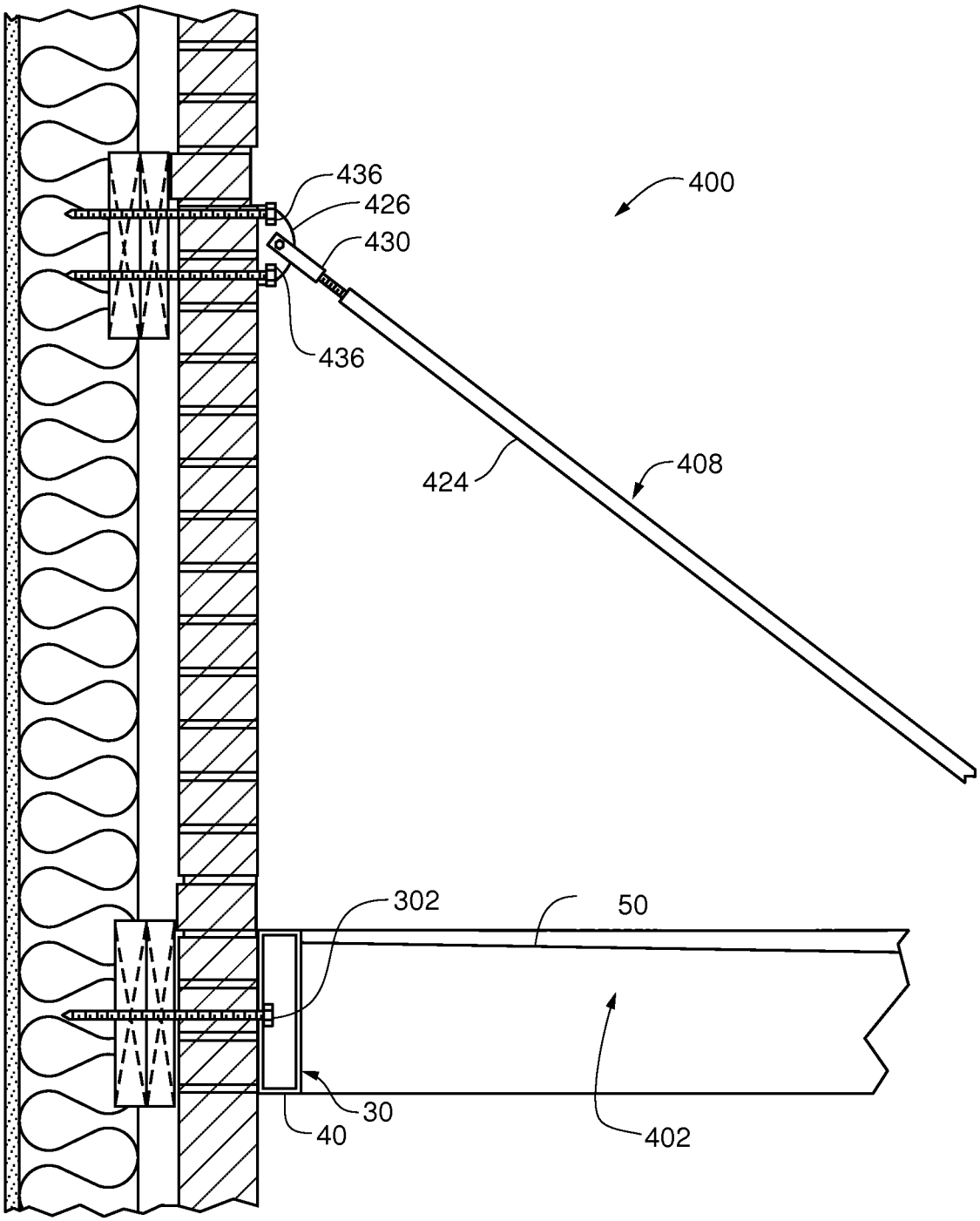
FIG. 26 shows a side perspective view of a trellis, according to an embodiment of the invention.
Figure 27:
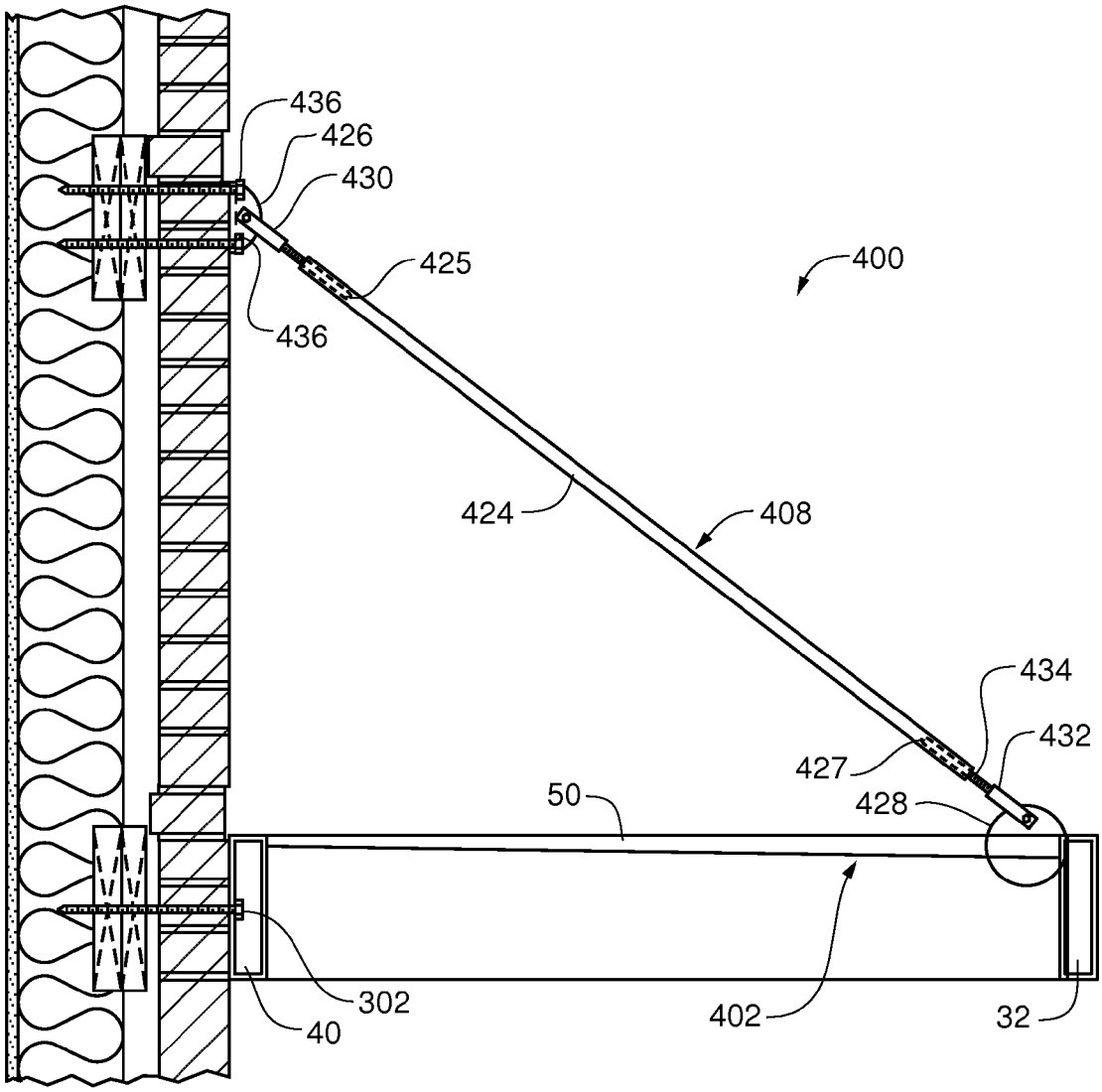
FIG. 27 shows a side perspective view of a trellis, according to the embodiment of FIG. 25.

Referring specifically to FIGS. 25-27, attachment assembly 408 comprises tieback rod 424, top anchoring clip 426, bottom anchoring clip 428, left-handed threaded stud 430, right-handed threaded stud 432, and nut 434. In an embodiment, tieback rod 424 is a galvanized or painted steel pipe. Top anchoring clip 426 is configured to be operably coupleable to the building surface via one or more fasteners 436. In one embodiment, as depicted in FIGS. 25-27, top anchoring clip 426 is substantially half-circle-shaped, wherein the flat side extends substantially parallel to the height of the building surface in a substantially vertical direction, and is secured by two fasteners 436 on opposite sides of top anchoring clip 426. In alternative embodiments, the flat side of top anchoring clip 426 extends in a substantially horizontal direction, and may be secured by one or more fasteners 436. In still alternative embodiments, top anchoring clip 426 may be substantially square or round and fastened appropriately. The shape or style of top anchoring clip 426 is not limited to the above-described embodiments.

A portion of top anchoring clip 426 is adapted to couple to left-handed threaded stud 430 at the curved end of top anchoring clip 426 distal the building surface. Tieback rod 424 is configured to receive a portion of left-handed threaded stud 430 distal the portion coupled to top anchoring clip 426. Accordingly at a first end 425 of tieback rod 424, a threaded shaft is presented. Likewise, at a second end 427 of tieback rod 424, a threaded shaft is presented such that tieback rod 424 is configured to receive a portion of right-handed threaded stud 432.

Similar to top anchoring clip 426, as depicted in FIG. 27, bottom anchoring clip 428 is substantially half-circle-shaped, wherein the flat side extends substantially parallel to the length of cross member 50. Instead of operably coupling to an eyebolt and eyebolt shaft as described in previous embodiments, cross member 50 is operably coupled to attachment assembly 408 via bottom anchoring clip 428 and appropriate fasteners on opposite sides of bottom anchoring clip 428. Further, bottom anchoring clip 428 is adapted to operably couple to right-handed threaded stud 432 in a manner similar to the coupling between top anchoring clip 426 and left-handed threaded stud 430. Nut 434 is designed to be threaded along right-handed threaded stud 432 and such that it abuts tieback rod 424 to provide an adjustable, secure length to vary the height of trellis 402.

In operation, in one embodiment, to secure attachment assembly 408 and trellis 402, top anchoring clip 426 is secured to the building with fasteners 436 as ⅜" stainless steel lag bolts in combination with flat washers. Left-hand threaded stud 430 is operably coupled to top anchoring clip 426 to form one end of an anchor for tieback rod 424. Trellis 402 via back tube 40 is mounted to the building with fasteners 302 as ⅜" stainless steel lag bolts in combination with an SAE washer. Tieback rod 424 is then threaded into left-handed threaded stud 430 at first end 425 such that tieback rod 424 extends at an angle towards the distal end of cross member 50. Nut 434 is threaded onto right-handed threaded stud 432, and right-handed threaded stud 432 is threaded into tieback rod 424 at second end 427 such that nut 434 loosely abuts tieback rod 424. Right-handed threaded stud 432 is then operably coupled to bottom anchoring clip 428. Bottom anchoring clip is then operably coupled to cross member 50 at a position near the distal end of cross member 50. The trellis 402 is then leveled by turning tieback rod 424 and tightening nut 434 to lock tieback rod 424 securely in place. Finally, after the trellis 402 is cleaned with, for example, a zylene solvent, finish plugs are inserted at the trellis 402 anchoring.

In one embodiment, referring to FIG. 25, top anchoring clip 426 and fastener 302 for back tube 40 are secured through a relatively thin building wall material. In such an embodiment, fasteners 436 are, for example, ⅜"×6" stainless steel lag bolt and SAE washer. Likewise, fasteners 302 to secure cross member 50 back tube 40 are also ⅜"×6" stainless steel lag bolt and SAE washer. A double 2×10 wood blocking between studs can be utilized to support fasteners 436 as well as fasteners 302.

In another embodiment, referring to FIG. 26, top anchoring clip 426 and fastener 302 for back tube 40 are secured through a relatively thick building wall material. In such an embodiment, fasteners 436 are, for example, ⅜"×10" stainless steel lag bolt and SAE washer. Likewise, fasteners 302 to secure cross member 50 back tube 40 are also ⅜"×10" stainless steel lag bolt and SAE washer. A 2×10 wood blocking between studs can be utilized to support fasteners 436 as well as fasteners 302.

Figure 29:
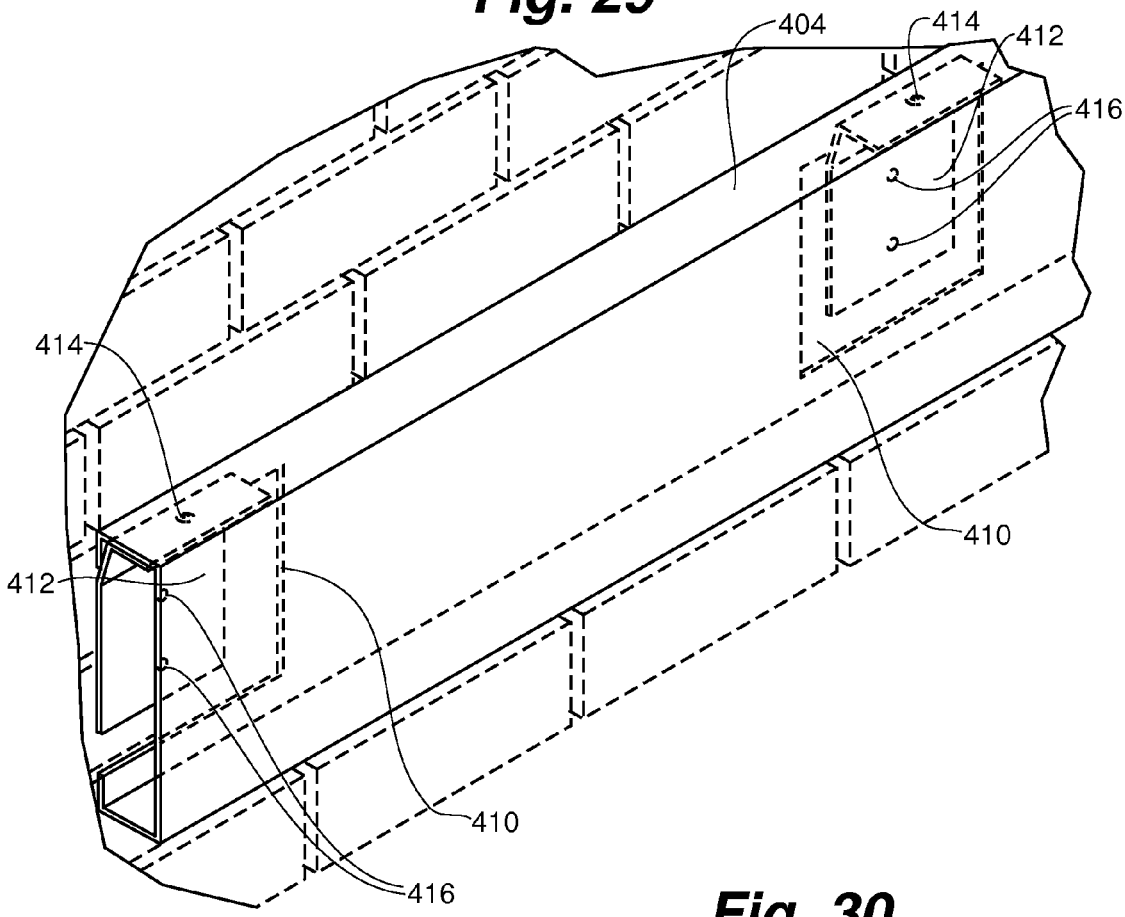
FIG. 29 shows a perspective view of a C-shaped accent band attached to a wall, according to an embodiment of the invention.
Figure 30:
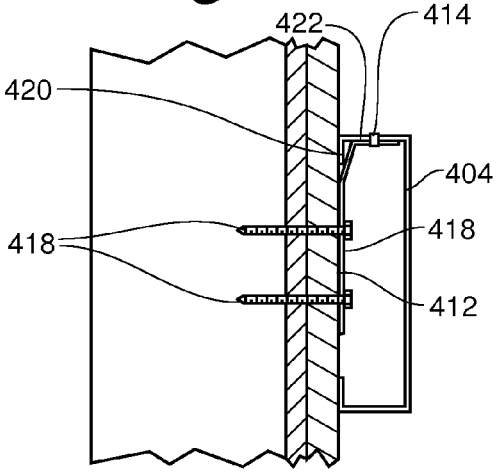
FIG. 30 shows a side perspective of an attachment of a C-shaped accent band to a wall, according to an embodiment of the invention.

Referring specifically to FIGS. 29 and 30, accent bands 404 comprise elongated tubes that can be affixed to the side of the building, as well as apertures 410 for receiving accent band clips 412. Accent bands 404, in one embodiment, harmoniously blend with the structure of the trellis. In another embodiment, the accent bands 404 can provide a counterpoint with the trellis, if that is the desired aesthetic appearance. Accent bands 404 are generally elongated tubes with a quadrilateral cross-section, and preferably a rectangular cross-section, as depicted in FIGS. 29 and 30.

Accent band clip 412 is substantially L-shaped, comprising a mounting portion 418 that is planar and designed to mount flush to the building wall surface, an angling portion 420 that provides a length such that accent band clip 412 angles from mounting portion 418, and a lip 422 that extends from angling portion 420. Lip 422 is substantially perpendicular to mounting portion 418, with angling portion 420 extended therebetween. Mounting portion 418 contains one or more apertures 416 for receiving fasteners 418 appropriate for mounting accent band 404 into the building wall surface. Aperture 416 can be a 3/16" hole, for example. Accent band clips 412 are secured to accent band 404 to provide support to accent band 404.

During installation of accent band 404, before mounting to the building wall surface, apertures 410 are created intermittently along the side of accent band 404 to be placed against the wall surface and positioned as required for respective accent band clips 412 to support accent band 404, whereby lip 422 is abuttingly engaged with the interior surface of the top of the respective accent band. Apertures 410 can be a 6"×6" square, for example. Fasteners 418, for example ¼" screws that meet building wall conditions, secure accent band clip 412 to the building wall surface through apertures 416. A secured accent band clip 412 is then received through aperture 410. Aperture 414 is created to define a void extending through the surface of accent band 404 that is orthogonally-facing to the building wall and abuttingly engaged with the lip 422 (for example, the top), and the surface of lip 422 of the respective accent band clip. Another fastener (a rivet, for example—not depicted) is placed through aperture 414 to secure accent band 404 to accent band clip 412.

Figure 28:
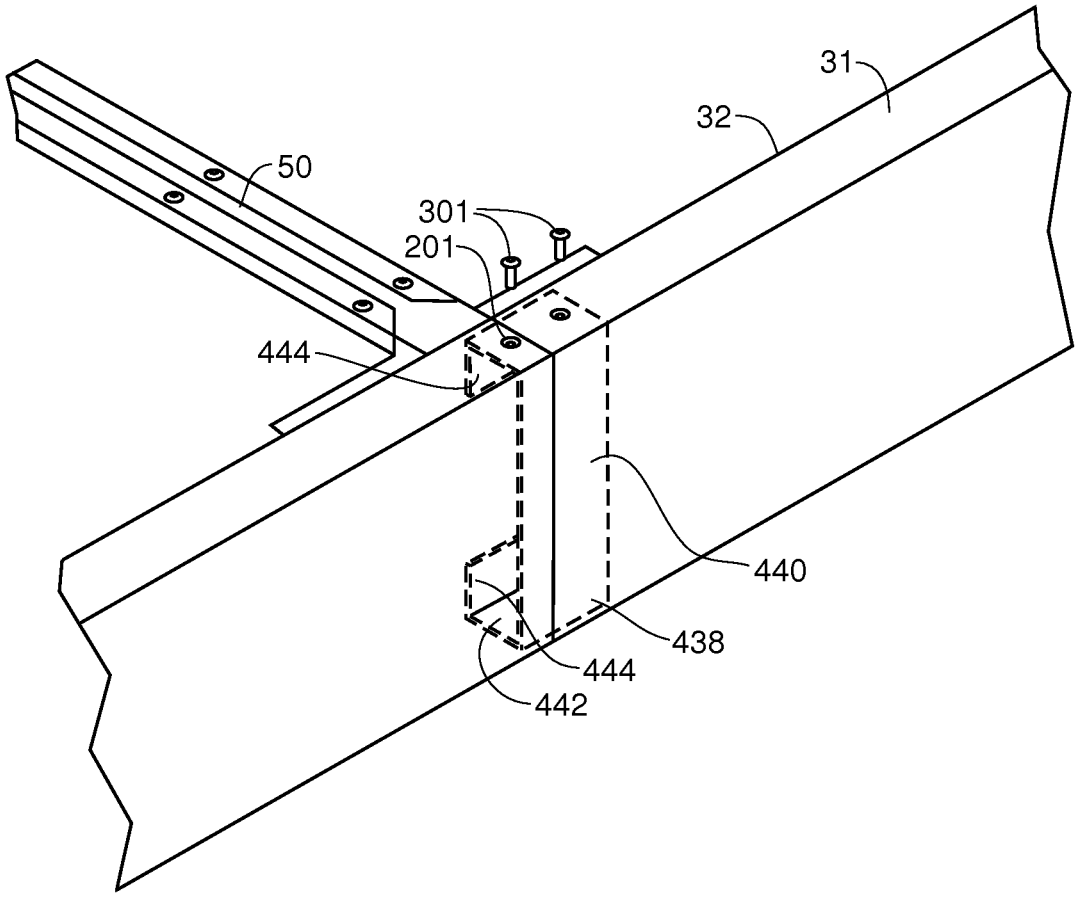
FIG. 28 shows a perspective view of a splice of two front tubes at a cross member, according to an embodiment of the invention.

Frame 30 can utilize a splice sleeve of shapes other than those that are U-shaped, according to an embodiment of the invention. Referring to FIG. 28, a splice sleeve 438 of a substantially C-shape is depicted. Splice sleeve 438 includes a planar segment 440 that forms the backbone of the C-shape. Legs 442 extend substantially perpendicularly from planar segment 440 at opposite ends of planar segment 440, but on the same side of planar segment 440, such that legs 442 are parallel to and a position each other. Lips 444 extend substantially perpendicularly from each of legs 442 in a direction towards each other and therefore substantially parallel to planar segment 440. Splice sleeve 438 is configured to be abuttingly engageable with the interior surfaces of the end portions of a back tube 40, end tube 36 or front tube 32; the legs 442 of the splice sleeve 438 abuttingly engageable with a top 31, 41, 35, and a bottom surface 33, 43, 37, respectively, of a tube; the lips 444 of splice sleeve 438 abuttingly engageable with an opposing side from back tube 40, end tube 36 or front tube 32, respectively, from the portion of back tube 40, end tube 36 or front tube 32 abuttingly engaged with planar segment 440. The surface of at least one of the legs 442 of the splice sleeve 438 defines at least two apertures 201, each adapted to receive a fastener 301.

Figure 31:
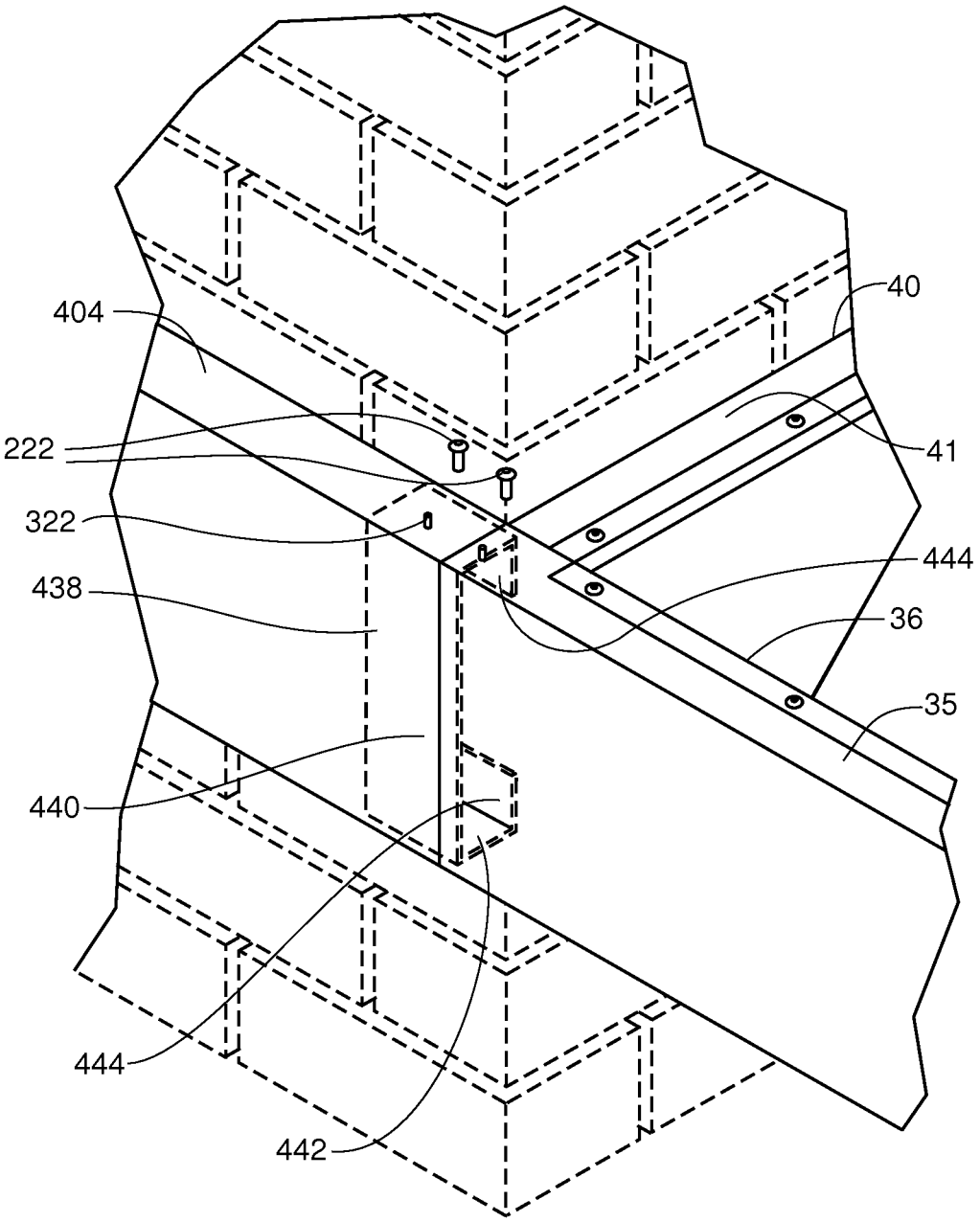
FIG. 31 shows a perspective view of a joining of an accent band, back tube, and end tube, at a building corner, according to an embodiment of the invention.

Referring to FIG. 31, a C-shaped splice sleeve 438 can be utilized to join accent band 404 with the assembled trellis 402. After the trellis 402 is installed, the accent band 404 is slid into the back of the trellis such that a hairline joint is created with the end tube 36. The splice sleeve 438 is positioned such that a portion of each of the legs 442 overlaps the interior surface of the accent band 404 and a portion of each of the legs 442 overlaps the interior surface of end tube 36. Planar segment 440 and lips 444 abuttingly engage opposite sides of the interior surfaces of both accent band 404 and end tube 36 to provide additional support. Apertures 222 are created once the splice sleeve 438 is positioned so that one aperture 222 is placed through accent band 404 and one aperture 222 is placed through end tube top 35. In one embodiment, apertures 222 are 3/16" holes. Fastener 322 is positioned at the top of the accent band 404 and end tube top 35 surfaces and subsequently passes through aperture 222, and is used to fasten the accent band 404 and the end tube 36 to the splice sleeve 438. In one embodiment, fasteners 322 are 3/16" rivets.

Figure 34:
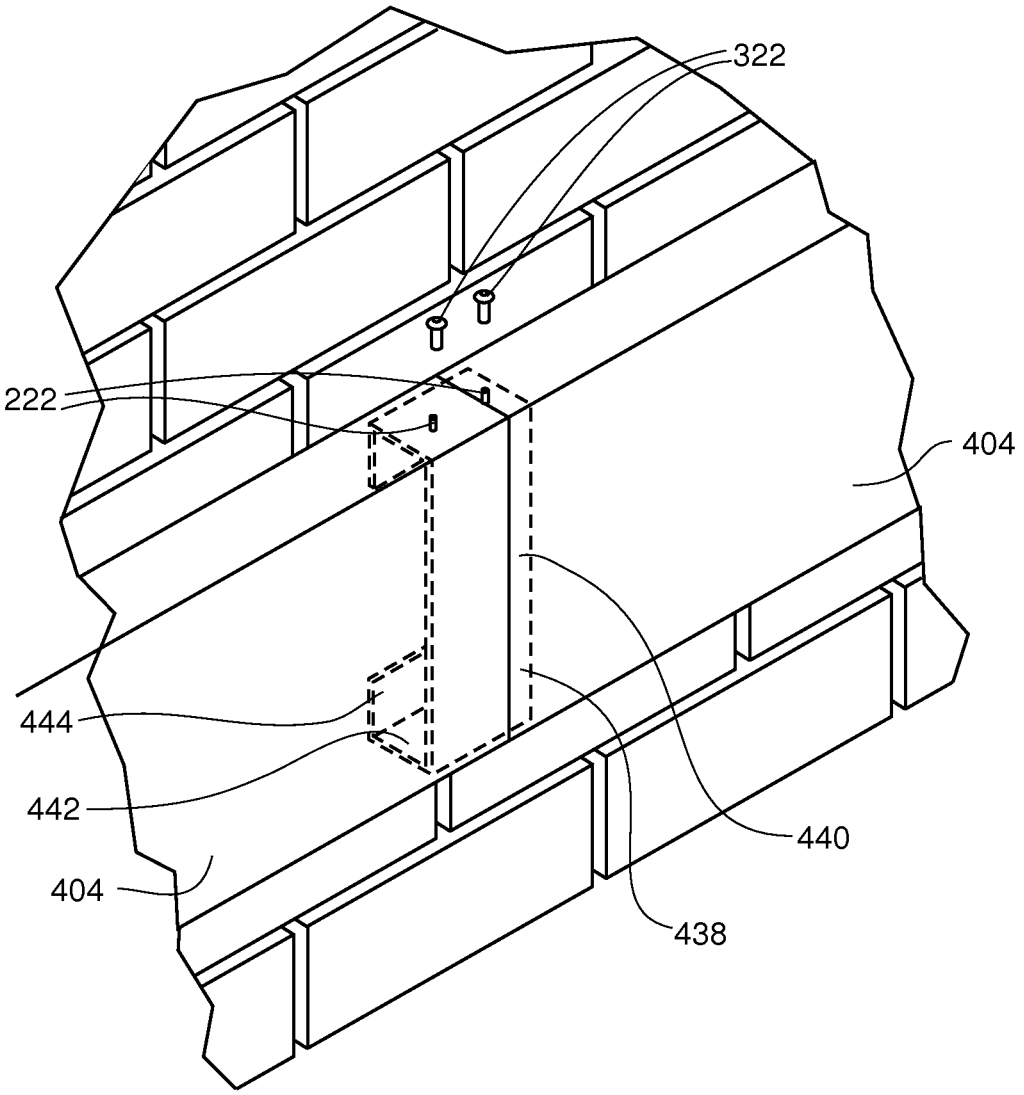
FIG. 34 shows a perspective view of two accent bands joined along a building wall.

Using splice sleeve 438, as described above, the accent bands 404 can be spliced to one another, to the back tube 40 and/or the end tubes 36, resulting in a hairline joint. An example of a splice of two accent bands 404 is shown in FIG. 34. The adjacent accent bands 404 or tubes that create the aforementioned hairline joints can be operably coupled using the aperture and fastener placement described above.

Figure 32:
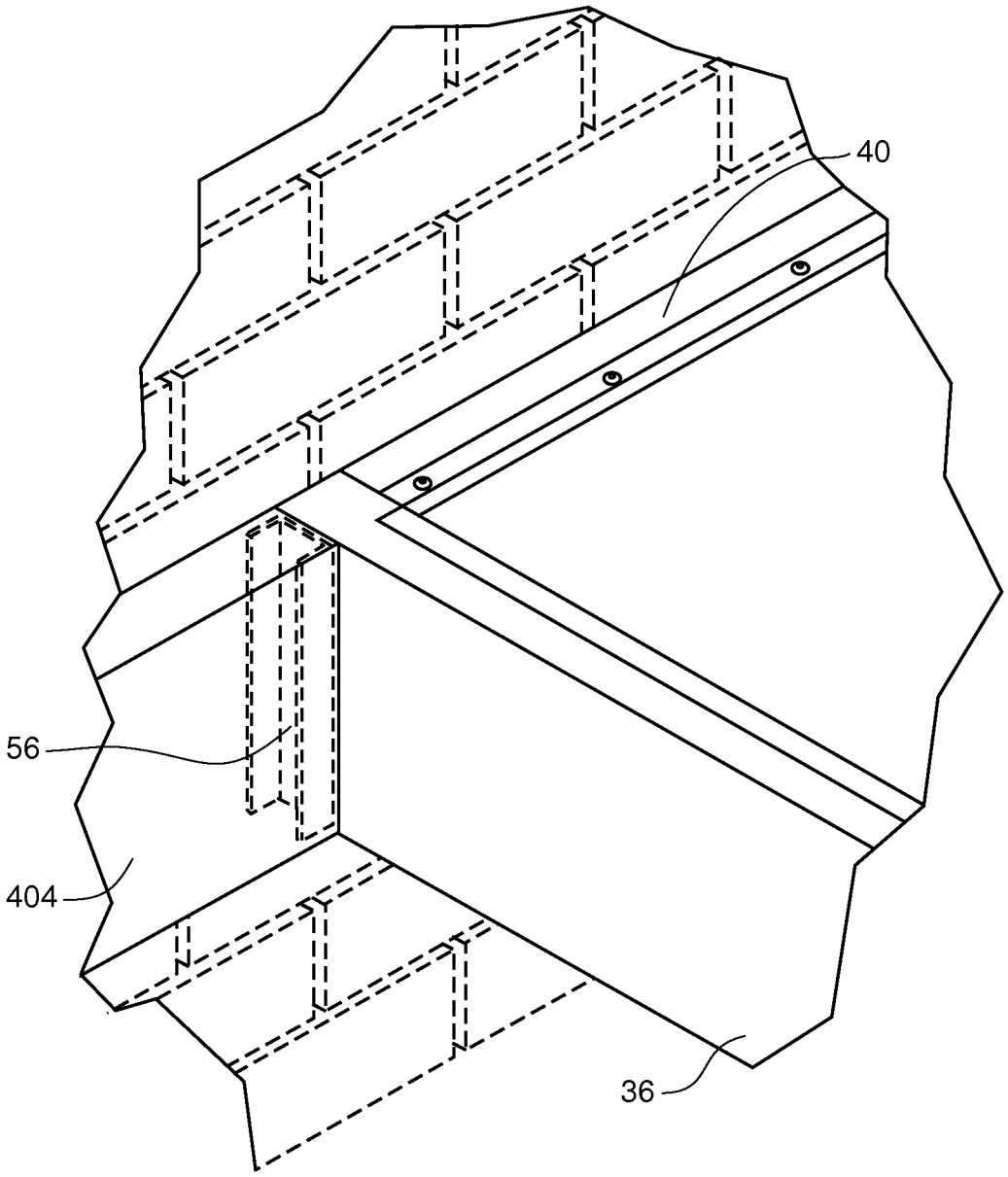
FIG. 32 shows a perspective view of a joining of an accent band and end tube, according to an embodiment of the invention.
Figure 33:
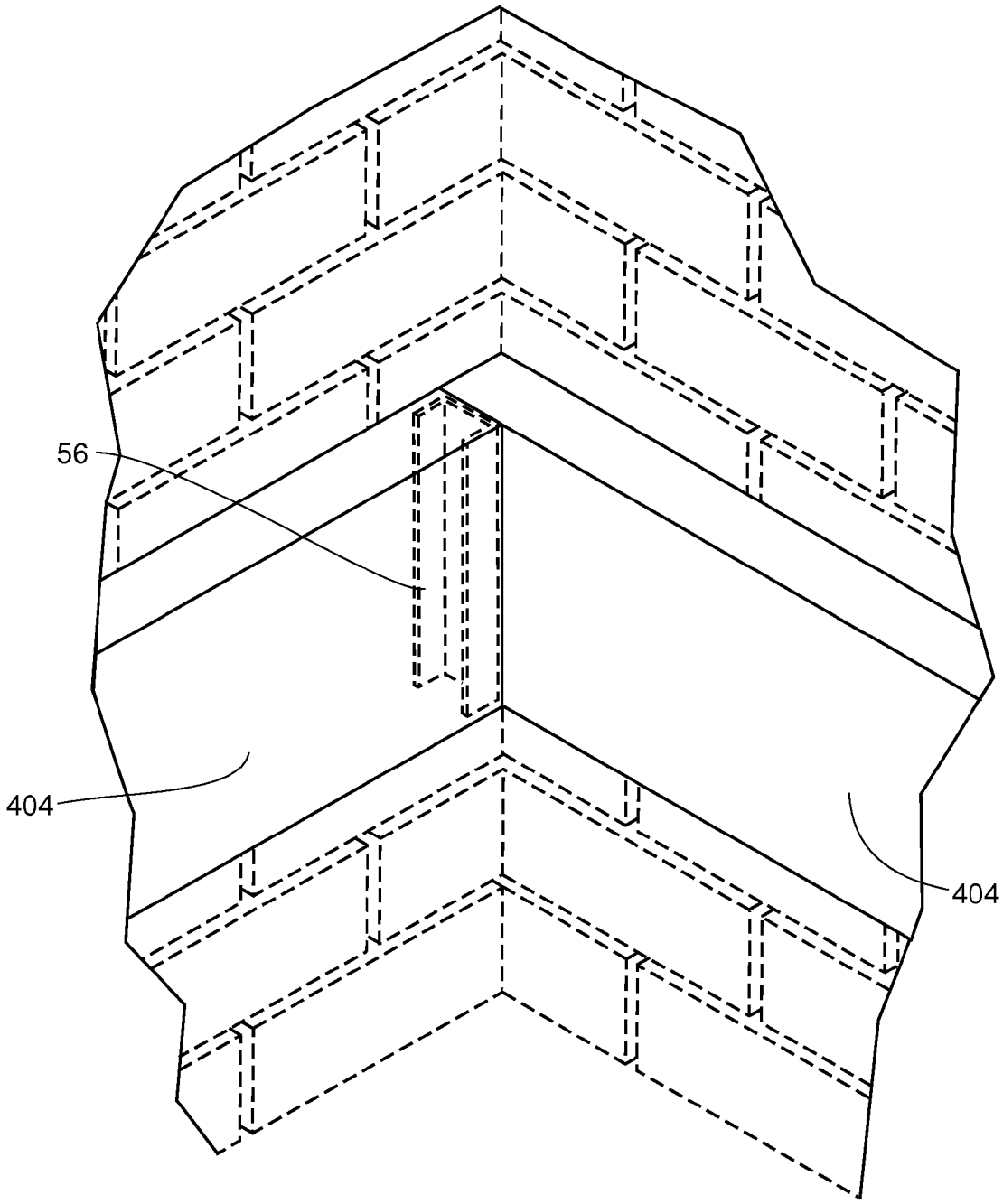
FIG. 33 shows a perspective view of two accent bands joined at a building exterior corner, according to an embodiment of the invention.

To turn corners with accent band 404, a shear block 56 can be utilized. Referring to FIG. 32, a corner turn between an end tube 36 and an accent band 404 is depicted, wherein a shear block 56 is affixed to the end tube 36. Accent band 404 is then slid over shear block 56 to create a hairline joint, with accent band 404 positioned orthogonally to end tube 36. Referring to FIG. 33, a corner turn between two accent bands 404 is depicted, wherein a shear block 56 is affixed to a first accent band 404. A second accent band 404 fits over the shear block 56, with second accent band 404 positioned orthogonally to first accent band 404. A hairline joint is thus created between first accent band 404 and second accent band 404.

Those skilled in the art will recognize that the present invention may be manifested in a variety of forms other than the specific embodiments described and contemplated herein. Accordingly, departures in form and detail may be made without departing from the scope and spirit of the present invention as described in the appended claims.

For purposes of interpreting the claims for the present invention, it is expressly intended that the provisions of Section 112, sixth paragraph of 35 U.S.C. are not to be invoked unless the specific terms "means for" or "step for" are recited in a claim.

The invention claimed is:

1. A trellis system comprising:

a trellis structure that is installable to extend generally outwardly from a vertical supporting member;

the trellis structure comprising:

a perimeter tube structure wherein exterior surfaces of the perimeter tube structure are contiguous; and at least one in-fill panel enclosed within and coupled to the perimeter tube structure, the at least one in-fill panel being coupled to the to the perimeter tube structure in at least two locations, each in-fill panel comprising at least one stiffener;

at least one diagonal support member configured to extend from proximate a front edge of the trellis structure diagonally toward the vertical supporting member; and a plurality of fasteners, each fastener coupling a first portion of the trellis structure to second portion of the trellis structure and each of the plurality of fasteners being positioned such that they do not penetrate an exterior surface of the perimeter tube structure or a bottom surface of the perimeter tube structure.

2. The trellis system as claimed in claim 1, further comprising an accent band, the accent band extending continuously and coplanarly with a back tube of the perimeter tube structure.

3. The trellis system as claimed in claim 1, further comprising an accent band, the accent band extending continuously and coplanarly with a side tube of the perimeter tube structure.

4. The trellis system as claimed in claim 1, wherein the diagonal support member is length adjustable.

5. The trellis system as claimed in claim 4, wherein the diagonal support member further comprises a turnbuckle whereby the diagonal support member is length adjustable.

6. A trellis system comprising:

a trellis structure that is installable to extend generally outwardly from a vertical supporting member;

the trellis structure comprising:

a perimeter tube structure wherein exterior surfaces of the perimeter tube structure are contiguous; and at least one in-fill panel enclosed within and coupled to the perimeter tube structure, the at least one in-fill panel being coupled to the to the perimeter tube structure in at least two locations;

at least one diagonal support member configured to extend from proximate a front edge of the trellis structure diagonally toward the vertical supporting member; and a plurality of fasteners, each fastener coupling a first portion of the trellis structure to second portion of the trellis structure and each of the plurality of fasteners being positioned such that they do not penetrate an exterior surface of the perimeter tube structure or a bottom surface of the perimeter tube structure; and band clips and wherein at least the back tube defines apertures through which the band clips are receivable wherein the band clips are configured to be attachable to the vertical supporting member and whereby a back tube of the perimeter tube structure is securable to the vertical supporting member.

7. The trellis system as claimed in claim 6, wherein the band clip further comprises a mounting portion, an angling portion extending from the mounting portion and a lip outwardly from and substantially perpendicular to the angling portion.

8. The trellis system as claimed in claim 1, wherein the perimeter tube structure further comprises a front tube, a back tube and two side tubes and wherein at least one of the front tube and the back tube are joined to the two side tubes by miter joints.

9. The trellis system as claimed in claim 8, wherein the in-fill panels are each coupled to front tube and the back tube.

10. The trellis system as claimed in claim 8, wherein at least some of the in-fill panels comprise end in fill panels and wherein the end in-fill panels are coupled to one of the side tubes.

11. A trellis system comprising:

a trellis structure that is installable to extend generally outwardly from a vertical supporting member;

the trellis structure comprising:

a perimeter tube structure wherein exterior surfaces of the perimeter tube structure are contiguous; and at least one in-fill panel enclosed within and coupled to the perimeter tube structure, the at least one in-fill panel being coupled to the to the perimeter tube structure in at least two locations;

at least one diagonal support member configured to extend from proximate a front edge of the trellis structure diagonally toward the vertical supporting member; and a plurality of fasteners, each fastener coupling a first portion of the trellis structure to second portion of the trellis structure and each of the plurality of fasteners being positioned such that they do not penetrate an exterior surface of the perimeter tube structure or a bottom surface of the perimeter tube structure; and wherein at least some fasteners of the plurality of fasteners each penetrate a top surface of the perimeter tube structure whereby the perimeter tube structure is coupled to other portions of the trellis structure.

12. A method of installing a trellis system, comprising:

assembling a perimeter tube structure having contiguous exterior surfaces;

securing at least one in-fill panel enclosed within and coupled to the perimeter tube structure, by coupling the at least one in-fill panel to the to the perimeter tube structure in at least two locations;

attaching each in-fill panel to at least one stiffener;

securing at least one diagonal support member to the trellis structure such that the diagonal support member extends from proximate a front edge of the trellis structure diagonally toward a vertical supporting member from which the trellis structure is hung;

securing a back tube of the perimeter tube structure to the vertical supporting member;

securing the diagonal support member to the vertical supporting member; and coupling a first portion of the trellis structure to second portion of the trellis structure with a plurality of fasteners and positioning each of the plurality of fasteners such that they do not penetrate an exterior surface of the perimeter tube structure or a bottom surface of the perimeter tube structure.

13. The method as claimed in claim 12, further comprising attaching an accent band to the vertical supporting member such that the accent band extends continuously and coplanarly with a back tube of the perimeter tube structure.

14. The method as claimed in claim 12, further comprising attaching an accent band to the vertical supporting member such that the accent band extends continuously and coplanarly with a side tube of the perimeter tube structure.

15. The method as claimed in claim 12, further comprising installing the diagonal support member wherein the diagonal support member is length adjustable and adjusting a length of the diagonal support member to level the trellis structure or adjust the trellis structure to a desired angle.

16. A method of installing a trellis system, comprising:

assembling a perimeter tube structure having contiguous exterior surfaces;

securing at least one in-fill panel enclosed within and coupled to the perimeter tube structure, by coupling the at least one in-fill panel to the to the perimeter tube structure in at least two locations;

securing at least one diagonal support member to the trellis structure such that the diagonal support member extends from proximate a front edge of the trellis structure diagonally toward a vertical supporting member from which the trellis structure is hung;

securing a back tube of the perimeter tube structure to the vertical supporting member;

securing the diagonal support member to the vertical supporting member;

coupling a first portion of the trellis structure to second portion of the trellis structure with a plurality of fasteners and positioning each of the plurality of fasteners such that they do not penetrate an exterior surface of the perimeter tube structure or a bottom surface of the perimeter tube structure; and securing band clips to the vertical supporting member and coupling the band clips to apertures in a back tube of the perimeter tube structure through which the band clips are receivable.

17. The method as claimed in claim 16, further comprising coupling a mounting portion of the band clip and engaging an angling portion extending from the mounting portion and a lip extending outwardly from and substantially perpendicular to the angling portion to the back tube via the aperture.

18. The method as claimed in claim 12, further comprising assembling a front tube, a back tube and two side tubes to form the perimeter tube structure.

19. The method as claimed in claim 12, further comprising coupling the in-fill panels to front tube and the back tube.

20. The method as claimed in claim 12, further comprising coupling at least some of the in-fill panels that comprise end in fill panels to one of the side tubes.

21. The method of claim 20 further comprising providing at least one accent band and affixing the accent band contiguously and coplanarly to the back tube.

22. The method of claim 20 further comprising providing a plurality of stiffeners and adhering the stiffeners spacedly to the roof panels.

23. The method of claim 20 further comprising providing at least one accent band and affixing the accent band contiguously and coplanarly to at least one of the side tubes.

24. The trellis system as claimed in claim 6, further comprising an accent band, the accent band extending continuously and coplanarly with a back tube of the perimeter tube structure.

25. The trellis system as claimed in claim 6, further comprising an accent band, the accent band extending continuously and coplanarly with a side tube of the perimeter tube structure.

26. The method as claimed in claim 16, further comprising attaching an accent band to the vertical supporting member such that the accent band extends continuously and coplanarly with a back tube of the perimeter tube structure.

27. The method as claimed in claim 16, further comprising attaching an accent band to the vertical supporting member such that the accent band extends continuously and coplanarly with a side tube of the perimeter tube structure.

* * * * *